US006454904B1

(12) United States Patent
Hermans et al.

(10) Patent No.: US 6,454,904 B1
(45) **Date of Patent: *Sep. 24, 2002**

(54) METHOD FOR MAKING TISSUE SHEETS ON A MODIFIED CONVENTIONAL CRESCENT-FORMER TISSUE MACHINE

(75) Inventors: Michael Alan Hermans, Neenah; Frank Stephen Hada, Appleton, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/607,712

(22) Filed: Jun. 30, 2000

(51) Int. Cl.[7] ..... D21F 11/00

(52) U.S. Cl. ..... 162/205; 162/207; 162/290; 162/297

(58) Field of Search ..... 162/115, 205, 162/207, 290, 297, 301, 353, 359.1; 34/452, 634

(56) References Cited

U.S. PATENT DOCUMENTS

| | | | |
|---|---|---|---|
| 3,224,928 | A | 12/1965 | Lee et al. |
| 3,841,910 | A | 10/1974 | Baker |
| 4,116,762 | A | 9/1978 | Gardiner |
| 4,139,410 | A | 2/1979 | Tapio et al. |
| 4,157,938 | A | 6/1979 | Clemens et al. |
| 4,270,978 | A | 6/1981 | Fioravanti |
| 4,272,316 | A | 6/1981 | Justus |
| 4,361,466 | A | 11/1982 | Wong et al. |
| 4,888,096 | A | 12/1989 | Cowan et al. |
| 5,020,242 | A | 6/1991 | Mayer et al. |
| 5,225,042 | A | 7/1993 | Eaton et al. |
| 5,230,776 | A | 7/1993 | Andersson et al. |
| 5,306,395 | A | 4/1994 | Myren |
| 5,348,620 | A | 9/1994 | Hermans et al. |
| 5,397,437 | A | 3/1995 | Ingemar |
| 5,429,686 | A | 7/1995 | Chiu et al. |
| 5,501,768 | A | 3/1996 | Hermans et al. |
| 5,830,321 | A | 11/1998 | Lindsay et al. |
| 5,865,955 | A | 2/1999 | Ilvespaa et al. |
| 6,080,279 | A | 6/2000 | Hada et al. |
| 6,083,346 | A | 7/2000 | Hermans et al. |
| 6,093,284 | A | 7/2000 | Hada et al. |
| 6,096,169 | A | 8/2000 | Hermans et al. |
| 6,143,135 | A | 11/2000 | Hada et al. |
| 6,149,767 | A | 11/2000 | Hermans et al. |
| 6,187,137 | B1 | 2/2001 | Druecke et al. |
| 6,197,154 | B1 | 3/2001 | Chen et al. |

FOREIGN PATENT DOCUMENTS

| | | |
|---|---|---|
| EP | 0 616 074 A1 | 9/1994 |
| GB | 1057373 | 2/1967 |
| GB | 2 152 961 A | 8/1985 |
| GB | 2 179 949 B | 3/1987 |
| GB | 2 179 953 A | 3/1987 |
| WO | WO 97/43484 A1 | 11/1997 |
| WO | WO 99/23296 A1 | 5/1999 |
| WO | WO 99/23300 A1 | 5/1999 |
| WO | WO 99/23301 A1 | 5/1999 |
| WO | WO 99/23302 A1 | 5/1999 |

*Primary Examiner*—Dean T. Nguyen
(74) *Attorney, Agent, or Firm*—Patricia A. Charlier

(57) ABSTRACT

A tissue sheet is made using a modified wet pressing process employing an integrally sealed air press. After initial formation and conventional vacuum dewatering, the wet web may be conformed to the surface contour of a relatively coarse fabric to give the web a textured surface. By creating a pressure differential across the web, the air press noncompressively dewaters the wet web to a consistency of about 30 to about 40 percent prior to a heated drying cylinder. The web may be dried to substantially preserve its three-dimensional, throughdried-like texture. The process provides a web having an exceptionally high degree of bulk and absorbency not expected in wet-pressed products.

53 Claims, 9 Drawing Sheets

METHOD FOR MAKING TISSUE SHEETS ON A MODIFIED CONVENTIONAL CRESCENT-FORMER TISSUE MACHINE

BACKGROUND OF THE INVENTION

The present invention relates generally to methods for making paper products. More particularly, the invention concerns methods for making cellulosic webs having high bulk and absorbency on a modified conventional wet-pressed machine.

There are generally two different methods for making the base sheets for paper products such as paper towels, napkins, tissue, wipes and the like. These methods are commonly referred to as wet-pressing and throughdrying. While the two methods may be the same at the front end and back end of the process, they differ significantly in the manner in which water is removed from the wet web after its initial formation.

More specifically, in the wet-pressing method, the newly-formed wet web is typically transferred onto a papermaking felt and thereafter pressed against the surface of a steam-heated Yankee dryer while it is still supported by the felt. As the web is transferred to the surface of the Yankee dryer, water is expressed from the web and is absorbed by the felt. The dewatered web, typically having a consistency of about 40 percent, is then dried while on the hot surface of the Yankee dryer. The web is then creped to soften it and provide stretch to the resulting tissue sheet. A disadvantage of wet pressing is that the pressing step densifies the web, thereby decreasing the bulk and absorbency of the tissue sheet. The subsequent creping step only partially restores these desirable sheet properties.

In the throughdrying method, the newly-formed web is first dewatered using vacuum and then transferred to a relatively porous fabric and non-compressively dried by passing hot air through the web. The resulting web can then be transferred to a Yankee dryer for creping. Because the web is substantially dry when transferred to the Yankee dryer, the density of the web is not significantly increased by the transfer. Also, the density of a throughdried tissue sheet is relatively low by nature because the web is dried while supported on the throughdrying fabric. The disadvantages of the throughdrying method are the relatively high operational energy costs and the capital costs associated with the throughdryers.

Because the vast majority of existing tissue machines utilize the older wet-pressing method, it is of particular importance that manufacturers find ways to modify existing wet-pressed machines to produce the consumer-preferred low-density products without expensive modifications to the existing machines. Of course, it is possible to re-build wet-pressed machines to throughdried configurations, but this is usually prohibitively expensive. Many complicated and expensive changes are necessary to accommodate the throughdryers and associated equipment. In addition, the length of a through-air dried tissue machine is greater, requiring a building addition or modification. In some locations, building modifications are not practical or possible, or prohibitively expensive because of the interference with other existing equipment or limited area available on the site. Accordingly, there has been great interest in finding ways to modify existing wet-pressed machines without significantly altering the machine design.

As a specific example, an approach to modifying a crescent-former tissue machine is particularly desirable, as there are many existing crescent-former tissue machines that could benefit from the consumer-preferred low-density products that can be made with the improved process. Many older crescent-former tissue machines were provided with a lower felt run that could be easily adapted to serve as an additional fabric run required for certain embodiments of this invention. This invention discloses a simple method for modifying a crescent-former tissue machine.

One simple approach to modifying a wet-pressed machine to produce softer, bulkier tissue is described in U.S. Pat. No. 5,230,776 issued Jul. 27, 1993 to Andersson et al. The patent discloses replacing the felt with a perforated belt of wire type and sandwiching the web between the forming wire and this perforated belt up to the press roll. The patent also appears to disclose additional dewatering means, such as a steam blowing tube, a blowing nozzle, and/or a separate press felt, that may be placed within the range of the sandwich structure in order to further increase the dry solids content before the Yankee dryer. These extra drying devices are said to permit the machine to run at speeds at least substantially equivalent to the speed of throughdrying machines.

It is important to reduce the moisture content of the web coming onto the Yankee dryer, to maintain machine speed and to prevent blistering or lack of adhesion of the web. Referring to U.S. Pat. No. 5,230,776, the use of a separate press felt, however, tends to densify the web in the same manner as a conventional wet-pressed machine. The densification resulting from a separate press felt would thus negatively impacting the bulk and absorbency of the web.

Further, jets of air for dewatering the web are not per se effective in terms of water removal or energy efficiency. Blowing air on the sheet for drying is well known in the art and used in the hoods of Yankee dryers for convective drying. In a Yankee dryer hood, however, the vast majority of the air from the jets does not penetrate the web. Thus, if not heated to high temperatures, most of the air would be wasted and not effectively used to remove water. In Yankee dryer hoods, the air is heated to as high as 900 degrees Fahrenheit and high residence times are allowed in order to effectuate drying.

Thus, what is lacking and needed in the art is a practical method for making tissue sheets having high bulk and absorbency comparable to throughdried sheets on a modified, conventional wet-pressed machine.

SUMMARY OF THE INVENTION

It has now been discovered that a wet-pressed tissue can be made having bulk and absorbency properties equivalent to those of comparable throughdried products, while maintaining reasonable machine productivity. More particularly, wet-pressed cellulosic webs can be made by vacuum dewatering a wet web up to approximately 30 percent consistency, then using an integrally sealed air press to noncompressively dewater the sheet to 30 to 40 percent consistency. The wet web is desirably then transferred to a "molding" fabric substituted for the conventional wet-pressing felt in order to impart more contour or three-dimensionality to the wet web. The wet web is preferably thereafter pressed against the Yankee dryer while supported by the molding fabric and dried. The resulting product has exceptional wet bulk and absorbency exceeding that of conventional wet-pressed towels and tissue and equal to that of presently available throughdried products.

As used herein, "noncompressive dewatering" and "noncompressive drying" refer to dewatering or drying methods, respectively, for removing water from cellulosic webs that do not involve compressive nips or other steps causing significant densification or compression of a portion of the web during the drying or dewatering process.

The wet web is wet-molded in the process to improve the three-dimensionality and absorbent properties of the web. As used herein, "wet-molded" tissue sheets are those which are conformed to the surface contour of a molding fabric while at a consistency of about 30 to about 40 percent and then dried by thermal conductive drying means, such as a heated drying cylinder, as opposed to other drying means such as a throughdryer, before optional additional drying means.

The "molding fabrics" suitable for purposes of this invention include, without limitation, those papermaking fabrics which exhibit significant open area or three-dimensional surface contour sufficient to impart greater z-directional deflection of the web. Such fabrics include single-layer, multi-layer, or composite permeable structures. Preferred fabrics have at least some of the following characteristics: (1) On the side of the molding fabric that is in contact with the wet web (the top side), the number of machine direction (MD) strands per inch (mesh) is from 10 to 200 (3.94 to 78.74 per centimeter) and the number of cross-machine direction (CD) strands per inch (count) is also from 10 to 200 (3.94 to 78.74 per centimeter). The strand diameter is typically smaller than 0.050 inch (1.27 mm); (2) On the top side, the distance between the highest point of the MD knuckle and the highest point of the CD knuckle is from about 0.001 to about 0.02 or 0.03 inch (0.025 mm to about 0.508 mm or 0.762 mm). In between these two levels, there can be knuckles formed either by MD or CD strands that give the topography a 3-dimensional hill/valley appearance which is imparted to the sheet during the wet molding step; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and, (5) The fabric may be made to show certain geometric patterns that are pleasing to the eye, which typically repeat between every 2 to 50 warp yarns.

Hence, in one aspect, the invention resides in a method for making a cellulosic web, comprising: (a) depositing an aqueous suspension of papermaking fibers between an endless first fabric and an endless second fabric to form a wet web wherein the wet web is sandwiched between the first and second fabrics; (b) dewatering the wet web to a consistency of about 30 percent or greater using a noncompressive dewatering device that is adapted to cause a pressurized fluid at about 5 pounds per square inch gauge or greater to flow substantially through the web due to an integral seal formed with the wet web; (c) pressing the dewatered wet web against the surface of a heated drying cylinder to at least partially dry the dewatered wet web; and, (d) drying the dewatered wet web to a final dryness.

In another aspect, the invention resides in a method for making a cellulosic web, comprising: (a) depositing an aqueous suspension of papermaking fibers between an endless first fabric and an endless second fabric to form a wet web wherein the wet web is sandwiched between the first and second fabrics; (b) dewatering the wet web to a consistency of about 10 to about 30 percent; (c) supplementally dewatering the wet web to a consistency of about 30 to about 40 percent using an air press that is adapted to cause a pressurized fluid at about 5 pounds per square inch gauge or greater to flow substantially through the wet web due to an integral seal formed between an air plenum and a collection device to give the dewatered wet web a bulk of about 8 cubic centimeter per gram or greater; (d) pressing the dewatered wet web against the surface of a heated drying cylinder with a fabric to preserve the bulk of about 8 cubic centimeter per gram or greater; and, (e) drying the dewatered wet web to a final dryness.

In another aspect, the invention resides in a method for making a cellulosic web, comprising: (a) depositing an aqueous suspension of papermaking fibers between an endless first fabric and an endless second fabric to form a wet web wherein the wet web is sandwiched between the first and second fabrics; (b) passing the wet web sandwiched between the first and second fabrics between an air plenum and a collection device with the second fabric disposed between the wet web and the collection device, the air plenum and collection device being operatively associated and adapted to create a pressure differential across the wet web of about 30 inches of mercury or greater and a stream of pressurized fluid through the wet web of about 10 standard cubic feet per minute per square inch or greater; c) dewatering the wet web using the stream of pressurized fluid to a consistency of about 30 percent or greater; (d) pressing the dewatered wet web against the surface of a heated drying cylinder with the second fabric; and (e) drying the dewatered wet web to a final dryness.

In another aspect, the invention resides in a method of modifying a conventional crescent-former tissue machine having at least one felt and compressive dewatering devices, comprising: (a) replacing at least one felt with at least one fabric; and, (b) replacing compressive dewatering devices with non-thermal, noncompressive dewatering devices. Crescent-forming processing and equipment are discussed in U.S Pat. No. 3,224,928 issued to Lee et al. on Dec. 21, 1965 and incorporated herein by reference.

In another aspect, the invention resides in a method for making a cellulosic web, comprising the steps of: (a) depositing an aqueous suspension of papermaking fibers between an endless first fabric and an endless second fabric to form a wet web; (b) dewatering the wet web to a consistency to about 10 percent or greater using a combination of centrifugal force and fabric tension around the forming roll; (c) using a non-compressive dewatering device that is adapted to cause a pressurized fluid at about 5 pounds per square inch gauge or greater to flow substantially through the wet web due to an integral seal formed with the wet web; (d) transferring the wet web back to or retaining on the second fabric; (e) pressing the dewatered wet web against the surface of a heated drying cylinder to at least partially dry the wet web; and, (f) drying the wet web to a final dryness.

In another aspect, the invention resides in a method for making a cellulosic web, comprising the steps of: (a) depositing an aqueous suspension of papermaking fibers between an endless first fabric and an endless second fabric to form a wet web; (b) dewatering the wet web to a consistency to about 10 percent or greater using a combination of centrifugal force and fabric tension around a forming roll; (c) further dewatering the wet web to a consistency of 10 to about 30 percent; (d) supplementally dewatering the wet web to a consistency of about 30 to about 40 percent using an air press that is adapted to cause a pressurized fluid at about 5 pounds per square inch gauge or greater to flow substantially through the wet web due to an integral seal formed between an air plenum and a collection device; (e) transferring the wet web back to or retaining on the second fabric; (f) pressing the dewatered wet web against the surface of a heated drying cylinder to at least partially dry the wet web; and, (g) drying the wet web to a final dryness.

In another aspect, the invention resides in a method for making a cellulosic web, comprising the steps of: (a) depositing an aqueous suspension of papermaking fibers between an endless first fabric and an endless second fabric to form a wet web; (b) dewatering the wet web to a consistency of about 10 to about 30 percent; (c) supplementally dewatering the web to a consistency of about 30 to about 40 percent using an air press that is adapted to cause a pressurized fluid at about 5 pounds per square inch gauge or greater to flow substantially through the wet web due to an integral seal formed between an air plenum and a collection device; (d) transferring the wet web back to or retaining on the second fabric to give the wet web a bulk of about 8 cubic centimeter per gram or greater; (e) pressing the dewatered wet web against the surface of a heated drying cylinder with a fabric to preserve the bulk of about 8 cubic centimeter per gram or greater; and, (f) drying the wet web to a final dryness.

In yet another aspect, the invention resides in a method for making a cellulosic web, comprising the steps of: (a) depositing an aqueous suspension of papermaking fibers between an endless first fabric and an endless second fabric to form a wet web wherein at least one of the endless fabrics is a three-dimensional molding fabric; (b) passing the first and second fabrics with the wet web sandwiched therewithin between an air plenum and a collection device with the three dimensional molding fabric disposed between the wet web and the collection device, the air plenum and the collection device being operatively associated and adapted to create a pressure differential across the wet web of about 30 inches of mercury or greater and a stream of pressurized fluid through the wet web of about 10 standard cubic feet per minute per square inch or greater; (d) dewatering the wet web using the stream of pressurized fluid to a consistency of about 30 percent or greater; (e) pressing the dewatered wet web against the surface of a heated drying cylinder with a fabric; and, (f) drying the wet web to a final dryness.

The term "first fabric" is used herein to refer to any fabric used in tissue making as described herein or known in the art, including, but not limited to, forming, molding, and other support fabrics used in making tissue. However, the first fabric is preferably a forming fabric. The term "second fabric" is used herein to refer to any fabric used in tissue making as described herein or known in the art, including, but not limited to, forming, molding, and other support fabrics used in making tissue. However, the second fabric is preferably a molding fabric as described herein. Where the second fabric is a molding fabric, the resulting web is a molded web. The term "support fabric" is used herein to refer to any fabric used in tissue making as described herein or known in the art, including, but not limited to, forming, molding, or any other fabric used in making tissue.

The terms "integral seal" and "integrally sealed" are used herein to refer to: the relationship between the air plenum and the wet web where the air plenum is operatively associated and in indirect contact with the web such that about 85 percent or greater of the air fed to the air plenum flows through the web when the air plenum is operated at a pressure differential across the web of about 30 inches of mercury or greater; and, the relationship between the air plenum and the collection device where the air plenum is operatively associated and in indirect contact with the web and the collection device such that about 85 percent or greater of the air fed to the air plenum flows through the web into the collection device when the air plenum and collection device are operated at a pressure differential across the web of about 30 inches of mercury or greater.

The air press is able to dewater the wet web to very high consistencies due in large part to the high pressure differential established across the web and the resulting air flow through the web. In particular embodiments, for example, the air press can increase the consistency of the wet web by about 3 percent or greater, particularly about 5 percent or greater, such as from about 5 to about 20 percent, more particularly about 7 percent or greater, and more particularly still about 7 percent or greater, such as from about 7 to 20 percent. Thus, the consistency of the wet web upon exiting the air press may be about 25 percent or greater, about 26 percent or greater, about 27 percent or greater, about 28 percent or greater, about 29 percent or greater, and is desirably about 30 percent or greater, particularly about 31 percent or greater, more particularly about 32 percent or greater, such as from about 32 to about 42 percent, more particularly about 33 percent or greater, even more particularly about 34 percent or greater, such as from about 34 to about 42 percent, and still more particularly about 35 percent or greater.

By adding the integrally sealed air press dewatering step to the process, considerable improvements over the previously described existing processes can be achieved. First, and most importantly, a high enough consistency is achieved so that the process can operate at industrially useful speeds. As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values. Further, molding the sheet at high consistencies significantly improves the ability of the sheet to retain its three-dimensionality and thus also significantly improves the resulting caliper of the sheet. As used herein, the term "textured" or "three-dimensional" as applied to the surface of a fabric, felt, or uncalendered paper web, indicates that the surface is not substantially smooth and coplanar. Additionally, the present machine configuration is amenable to incorporating a rush transfer step, which again results in a significant increase in bulk and absorbency relative to the existing wet pressing processes.

Optional steam showers or the like may be employed before the air press to increase the post air press consistency and/or to modify the cross-machine direction moisture profile of the web. Furthermore, higher consistencies may be achieved when machine speeds are relatively low and the dwell time in the air press is relatively high.

The pressure differential across the wet web provided by the air press may be about 25 inches of mercury or greater, such as from about 25 to about 120 inches of mercury, particularly about 35 inches of mercury or greater, such as from about 35 to about 60 inches of mercury, and more particularly from about 40 to about 50 inches of mercury. This may be achieved in part by an air plenum of the air press maintaining a fluid pressure on one side of the wet web of greater than 0 to about 60 pounds per square inch gauge (psig), particularly greater than 0 to about 30 psig, more particularly about 5 psig or greater, such as about 5 to about 30 psig, and more particularly still from about 5 to about 20 psig. The collection device of the air press desirably functions as a vacuum box operating at 0 to about 29 inches of mercury vacuum, particularly 0 to about 25 inches of mercury vacuum, particularly greater than 0 to about 25 inches of mercury vacuum, and more particularly from about 10 to about 20 inches of mercury vacuum, such as about 15 inches of mercury vacuum. In some embodiments, the collection device of the air press may operate at 30 inches of mercury vacuum or greater. The collection device desirably but not necessarily forms an integral seal with the air plenum and draws a vacuum to facilitate its function as a collection device for air and liquid. Both pressure levels within both the air plenum and the collection device are desirably monitored and controlled to predetermined levels.

Significantly, the pressurized fluid used in the air press is sealed from ambient air to create a substantial air flow through the web, which results in the tremendous dewatering capability of the air press. The flow of pressurized fluid through the air press is suitably from about 5 to about 500 standard cubic feet per minute (SCFM) per square inch of open area, particularly about 10 SCFM per square inch of open area or greater, such as from about 10 to about 200 SCFM per square inch of open area, and more particularly about 40 SCFM per square inch of open area or greater, such as from about 40 to about 120 SCFM per square inch of open area. Desirably, of the pressurized fluid supplied to the air plenum, 70 percent or greater, particularly 80 percent or greater, and more particularly 90 percent or greater, is drawn through the wet web into the vacuum box. For purposes of the present invention, the term "standard cubic feet per minute" means cubic feet per minute measured at 14.7 pounds per square inch absolute and 60 degrees Fahrenheit (°F.).

The terms "air" and "pressurized fluid" are used interchangeably herein to refer to any gaseous substance used in the air press to dewater the wet web. The gaseous substance suitably comprises air, steam or the like. Desirably, the pressurized fluid comprises air at ambient temperature, or air heated only by the process of pressurization to a temperature of about 300° F. or less, more particularly about 150° F. or less.

The wet web is desirably attached to the Yankee dryer or other heated drying cylinder surface in a manner that preserves a substantial portion of the texture imparted by previous treatments, especially the texture imparted by molding on three-dimensional fabrics. The conventional manner used to produce wet-pressed creped paper is inadequate for this purpose, for in that method, a pressure roll is used to dewater the wet web and to uniformly press the wet web into a dense, flat state. For the present invention, the conventional substantially smooth press felt of the conventional crescent-former tissue machine is replaced with a textured material such as a foraminous fabric and desirably a throughdrying fabric. Tissue webs made according to the present method desirably have a bulk after being molded onto the three-dimensional fabric of about 8 cubic centimeters per gram (cc/g) or greater, particularly about 10 cc/g or greater, and more particularly about 12 cc/g or greater, and that bulk is maintained after being pressed onto the heated drying cylinder using the textured foraminous fabric.

For best results, significantly lower pressing pressures can be used as compared to conventional tissue making. Desirably, the zone of maximum load applied to the web should be about 400 psi or less, particularly about 350 psi or less, more particularly about 150 psi or less, such as between about 2 and about 50 psi, and most particularly about 30 psi or less, when averaged across any one-inch square region encompassing the point of maximum pressure. The pressing pressures measured in pounds per lineal inch (pli) at the point of maximum pressure are desirably about 400 pli or less, and particularly about 350 pli or less. Low-pressure application of a three-dimensional web structure onto a heated drying cylinder helps to maintain substantially uniform density in the dried web. Substantially uniform density is promoted by effectively dewatering the web with non-compressive means prior to the Yankee dryer attachment, and by selecting a foraminous fabric to contact the web against the dryer that is relatively free of high, inflexible protrusions that could apply high local pressure to the web. The fabric is desirably treated with an effective amount of a fabric release agent to promote detachment of the web from the fabric once the web contacts the dryer surface.

The absorbency of a tissue sheet may be characterized by its Absorbent Capacity and its Absorbent Rate. As used herein, "Absorbent Capacity" is the maximum amount of distilled water which a sheet can absorb, expressed as grams of water per gram of sample sheet. More specifically, the Absorbent Capacity of a sample sheet can be measured by cutting a 4 inch by 4 inch (101.6 by 101.6 mm) sample of the dry sheet and weighing it to the nearest 0.01 gram. The sample is dropped onto the surface of a room temperature distilled water bath and left in the bath for 3 minutes. The sample is then removed using tongs or tweezers and suspended vertically using a 3-prong clamp to drain excess water. Each sample is allowed to drain for 3 minutes. The sample is then placed in a weighing dish by holding the weighing dish under the sample and releasing the clamp. The wet sample is weighed to the nearest 0.01 gram. The Absorbent Capacity is the wet weight of the sample minus the dry weight (the amount of water absorbed), divided by the dry weight of the sample. At least five representative samples of each product should be tested and the results averaged.

The "Absorbent Rate" is the time it takes for a product to become thoroughly wetted out in distilled water. It is determined by dropping a pad comprised of twenty sheets, each measuring 2.5 inches by 2.5 inches (63.5 by 63.5 mm), onto the surface of a distilled water bath having a temperature of 30° C. The elapsed time, in seconds, from the moment the sample hits the water until it is completely wetted (as determined visually) is the Absorbent Rate.

The present method is useful to make a variety of absorbent products, including facial tissue, bath tissue, towels, napkins, wipes, or the like. For purposes of the present invention, the terms "tissue" or "tissue products" are used generally to describe such product structures, and the term "cellulosic web" is used to broadly refer to webs comprising or consisting of cellulosic fibers regardless of the finished product structure.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. The mixtures of any subset of the above mentioned or related fiber classes may be used. The fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20,1994 and U.S. Pat. No. 5,501,768 issued Mar. 26, 1996, both to M. A. Hermans et al.

Chemical additives may be also be used and may be added to the original fibers, to the fibrous slurry or added on the web during or after production. Such additives include opacifiers, pigments, wet strength agents, dry strength agents, softeners, emollients, humectants, viricides, bactericides, buffers, waxes, fluoropolymers, odor control materials and deodorants, zeolites, dyes, fluorescent dyes or whiteners, perfumes, debonders, vegetable and mineral oils, humectants, sizing agents, superabsorbents, surfactants, moisturizers, UV blockers, antibiotic agents, lotions, fungicides, preservatives, aloe-vera extract, vitamin E, or the like. The application of chemical additives need not be uniform, but may vary in location and from side to side in the tissue. Hydrophobic material deposited on a portion of the surface of the web may be used to enhance properties of the web.

The headbox may be stratified to permit production of a multilayered structure from a single headbox jet in the formation of a web. In particular embodiments, the web is produced with a stratified or layered headbox to preferentially deposit shorter fibers on one side of the web for improved softness, with relatively longer fibers on the other side of the web or in an interior layer of a web having three or more layers. The web is desirably formed on an endless loop of foraminous forming fabric which permits drainage of the liquid and partial dewatering of the web.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE DRAWINGS

Figure 1:
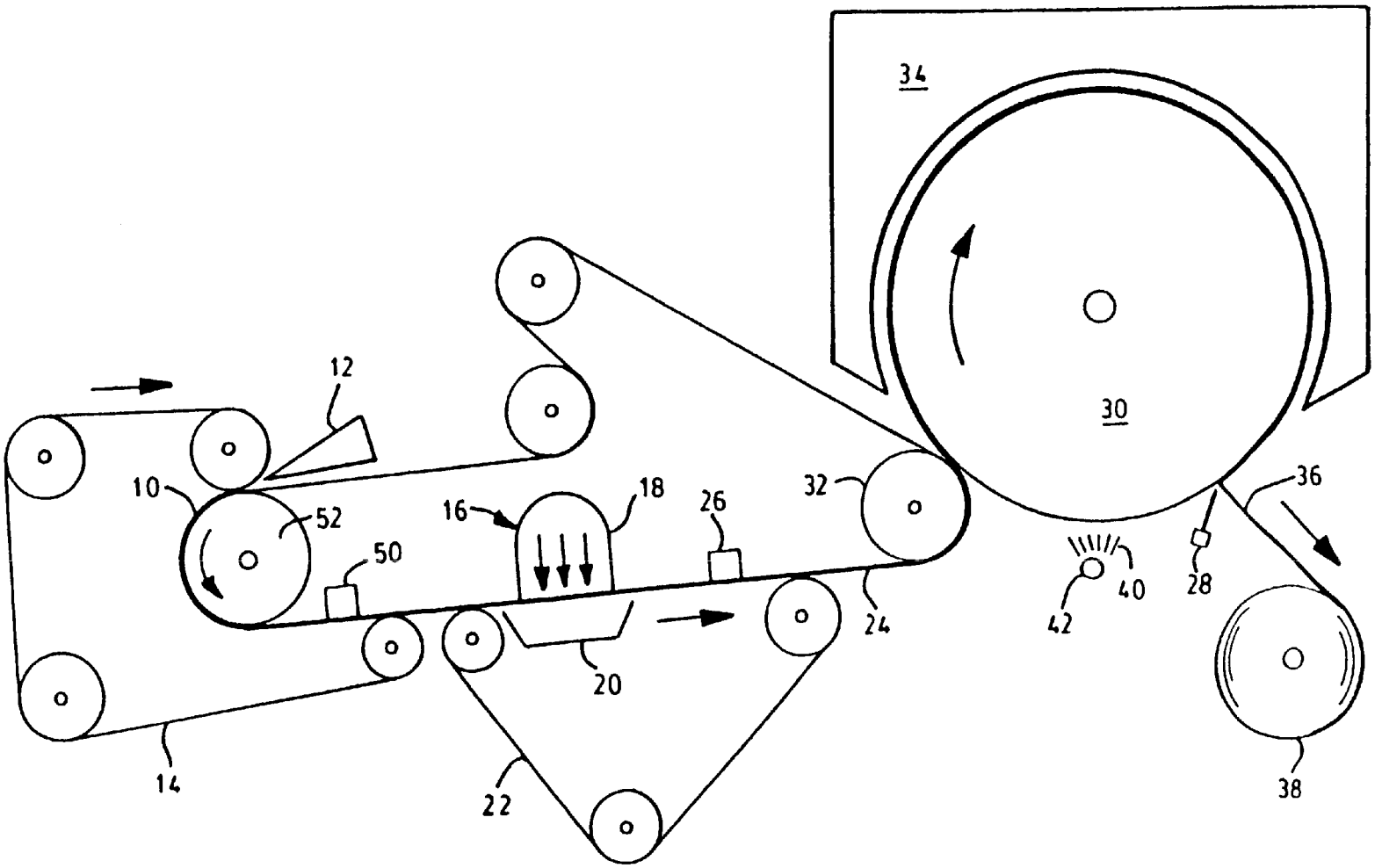
FIG. 1 representatively shows a schematic process flow diagram illustrating a method according to the present invention for making cellulosic webs having high bulk and absorbency.

The invention will now be described in greater detail with reference to the Figures, where similar elements in different Figures have been given the same reference numeral. For simplicity, the various tensioning rolls schematically used to define the several fabric runs are shown but not numbered. A variety of conventional papermaking apparatuses and operations can be used with respect to the stock preparation, headbox, forming fabrics, web transfers, creping and drying. Nevertheless, particular conventional components are illustrated for purposes of providing the context in which the various embodiments of the invention can be used.

The process of the present invention may be carried out on an apparatus as shown in FIG. 1 modified from a typical crescent-former tissue paper machine. An embryonic wet web 10 formed as a slurry of papermaking fibers is deposited from a headbox 12 between an endless loop of a first fabric 14 and an endless loop of a second fabric 24. The second fabric 24 generally replaces the felt of a standard crescent-former tissue machine. The consistency and flow rate of the slurry determines the dry web basis weight, which desirably is between about 5 and about 80 grams per square meter (gsm), and more desirably between about 8 and about 40 gsm. At least one of the fabrics 14 and 24 may be a forming fabric, preferably the first fabric 14. In addition, at least one of the fabrics 14 and 24 may be a molding fabric, preferably the second fabric 24.

The embryonic wet web 10 is partially dewatered by the pressure due to the tension on the first fabric 14 and the centrifugal force created as the wet web 10 passes around the forming roll 52 while the wet web 10 is carried between the first fabric 14 and the second fabric 24. Once the partial dewatering step is completed, the wet web 10 is transferred to or retained on the second fabric 24 with or without the use of a vacuum shoe 50.

For high-speed operation of the present invention, conventional tissue dewatering methods prior to the heated drying cylinder 30 may give inadequate water removal, so additional dewatering devices or means may be needed. In the illustrated embodiment, an air press 16 is used to noncompressively dewater the wet web 10. The illustrated air press 16 comprises an assembly of a pressurized air plenum 18 disposed above the wet web 10, a fluid collection device 20, shown in the form of a vacuum box, disposed beneath a support fabric 22 in operable relation with the pressurized air plenum 18 and the second fabric 24. (In alternative embodiments, the fluid collection device 20 may be disposed next to the second fabric 24 in operable relation with the pressurized air plenum 18 and the support fabric 22). While passing through the air press 16, the wet web 10 is sandwiched between the second fabric 24 and the support fabric 22 in order to facilitate sealing against the wet web 10 without damaging the wet web 10.

The air press 16 provides substantial rates of water removal, enabling the web to achieve dryness levels well over 30 percent prior to attachment to the drying cylinder 30, such as a Yankee dryer, desirably without the requirement for substantial compressive dewatering. Several embodiments of the air press 16 are described in greater detail hereinafter. Other suitable embodiments are disclosed in U.S. patent application Ser. No. 08/647,508 filed May 14, 1996 by M. A. Hermans et al. titled "Method and Apparatus for Making Soft Tissue," which is incorporated herein by reference.

Following the air press 16, the wet web 10 travels further with the second fabric 24 and the support fabric 22 until the wet web 10 is transferred back to the second fabric 24, preferably a textured fabric, with or without the assistance of a vacuum transfer shoe 26 at a transfer station.

The second fabric 24 may comprise a three-dimensional throughdrying fabric such as those disclosed in U.S. Pat. No. 5,429,686 issued Jul. 4, 1995 to K. F. Chiu et al., which is incorporated herein by reference, or may comprise other woven, textured webs or nonwoven fabrics. The second fabric 24 may be treated with a fabric release agent such as a mixture of silicones or hydrocarbons to facilitate subsequent release of the wet web 10 from the second fabric 24. The fabric release agent can be sprayed on the second fabric 24 prior to the pick-up of the web. Once on the second fabric 24, the wet web 10 may be further molded against the second fabric 24 through application of vacuum pressure or light pressing (not shown), though the molding that occurs at least due to vacuum forces at the transfer shoe 26 during pick-up may be adequate to mold the wet web 10.

The wet web 10 on the second fabric 24 is then pressed against a drying cylinder 30 by means of a pressure roll 32. The drying cylinder 30 is equipped with a vapor hood or Yankee dryer hood 34. The hood 34 typically employs jets of heated air at temperatures about 300° F. or greater, particularly about 400° F. or greater, more particularly about 500° F. or greater, and most particularly about 700° F. or greater, which are directed toward the tissue web 10 from nozzles or other flow devices such that the air jets have maximum or locally averaged velocities in the hood 34 of one of the following levels: about 10 meters per second (m/s) or greater, about 50 m/s or greater, about 100 m/s or greater, or about 250 m/s or greater.

The wet web 10 when affixed to the heated drying cylinder 30 suitably has a fiber consistency of about 30 percent or greater, particularly about 35 percent or greater, such as between about 35 and about 50 percent, and more particularly about 38 percent or greater. The dryness of the wet web 10 upon being removed from the heated drying cylinder 30 is increased to about 60 percent or greater, particularly about 70 percent or greater, more particularly about 80 percent or greater, more particularly still about 90 percent or greater, and most particularly between about 90 and about 98 percent. The wet web 10 can be partially dried on the heated drying cylinder 30 and wet creped at a consistency of about 40 to about 80 percent and thereafter dried (after-dried) to a consistency of about 95 percent or greater. Non-traditional hoods and impingement systems can be used as an alternative to or in addition to the Yankee dryer hood 34 to enhance drying of the wet web 10. Additional heated drying cylinders 30 or other drying means, particularly noncompressive drying, may be used after the first heated drying cylinder 30. Suitable means for after-drying include one or more heated drying cylinders 30, such as Yankee dryers and can dryers, throughdryers, or any other commercially effective drying means. Alternatively, the wet web 10, which may be molded if the second fabric 24 is a molding fabric, can be completely dried on the heated drying cylinder 30 and dry creped. The amount of drying on the heated drying cylinder 30 will depend on such factors as the speed of the wet web 10, the size of the heated drying cylinder 30, the amount of moisture in the wet web 10, and the like.

The resulting dried web 36 is drawn or conveyed from the heated drying cylinder 30, for example by a creping blade 28, after which it is reeled onto a roll 38. An interfacial control mixture 40 is illustrated being applied to the surface of the rotating heated drying cylinder 30 in spray form from a spray boom 42 prior to the wet web 10 contacting the surface of the heated drying cylinder 30. As an alternative to spraying directly on the surface of the heated drying cylinder 30, the interfacial control mixture 40 could be applied directly to either the wet web 10 or the surface of the heated drying cylinder 30 by gravure printing or could be incorporated into the aqueous fibrous slurry in the wet end of the paper machine. While on the surface of the heated drying cylinder 30, the wet web 10 may be further treated with chemicals, such as by printing or direct spray of solutions onto the drying web 10, including the addition of agents to promote release from the surface of the heated drying cylinder 30.

The interfacial control mixture 40 may comprise a conventional creping adhesive and/or dryer release agent for wet-pressed and creped operation. The dried web 36 may also be removed from the surface of the heated drying cylinder 30 without creping using an interfacial control mixture 40 of the type disclosed in U.S. patent application Ser. No. 08/961,773 now U.S. Pat. No. 6,187,137 filed on the same day as the present application by F. G. Druecke et al. titled "Method Of Producing Low Density Resilient Webs," which is incorporated herein by reference.

Figure 2:
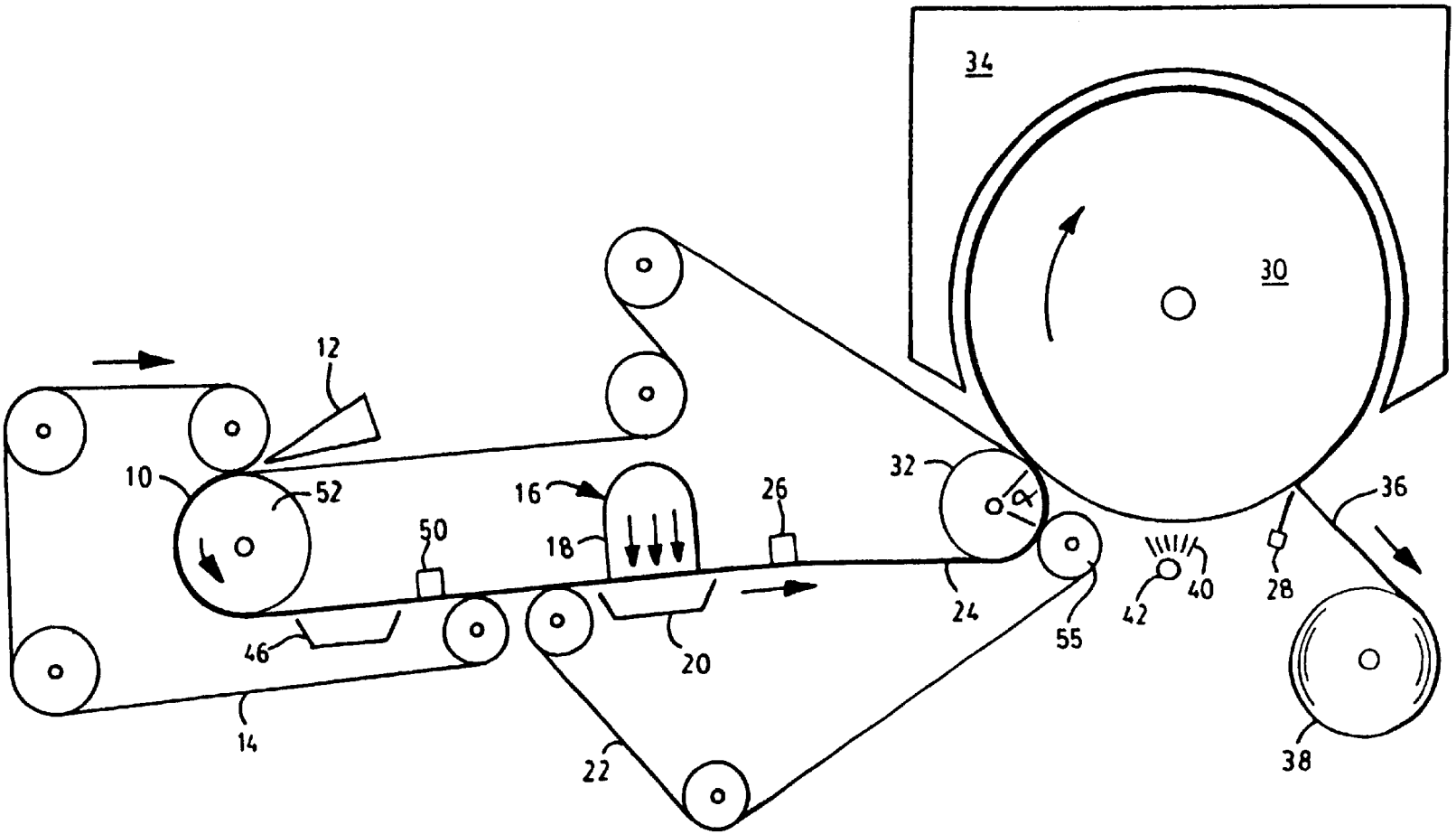
FIG. 2 representatively shows a schematic process flow diagram illustrating an alternative method according to the present invention.

An alternative embodiment is shown in FIG. 2, where an embryonic wet web 10 formed as a slurry of papermaking fibers is deposited from a headbox 12 between an endless loop of a first fabric 14 and an endless loop of a second fabric 24. The second fabric 24 generally replaces the felt of the standard crescent-former tissue machine. At least one of the fabrics 14 and 24 may be a forming fabric, preferably the first fabric 14. In addition, at least one of the fabrics 14 and 24 may be a molding fabric, preferably the second fabric 24.

The embryonic wet web 10 is partially dewatered by the pressure due to tension on the first fabric 14 and the centrifugal force created as the wet web 10 passes around the forming roll 52 while the wet web 10 is carried between the first fabric 14 and the second fabric 24. Once the partial dewatering step is completed, the wet web 10 is optionally further dewatered by a vacuum box 46 or other suitable devices while between the first fabric 14 and the second fabric 24 and is transferred to or retained on the second fabric 24 with or without the use of a vacuum shoe 50.

An air press 16 is used to noncompressively dewater the wet web 10 as it is sandwiched between the second fabric 24 and a support fabric 22. The illustrated air press 16 comprises an assembly of a pressurized air plenum 18 disposed in operable relation with a vacuum box 20. While passing through the air press 16, the wet web 10 is sandwiched between the second fabric 24 and the support fabric 22 with the support fabric 22 disposed between the wet web 10 and the vacuum box 20. (In alternative embodiments, the second fabric 24 may be disposed between the wet web 10 and the vacuum box 20).

The wet web 10 is then transferred with or without the assistance of the vacuum shoe 26 to the second fabric 24. A roll 55 of the run of the support fabric 22 is so oriented to change the direction of the second fabric 24, the support fabric 22, and the wet web 10 such that the wet web 10 is less likely to be released from the suction pressure roll 32 before the wet web 10 is transferred to the Yankee dryer or other heated drying cylinder 30. The roll 55 reduces the unsupported sheet wrap angle a thereby minimizes the opportunity of the wet web 10 to separate from the second fabric 24 before the wet web 10 is transferred to the heated drying cylinder 30.

The wet web 10 on the second fabric 24 is then pressed against a heated drying cylinder 30 by means of a pressure roll 32. The wet web 10 on the second fabric 24 is then pressed against a drying cylinder 30 by means of a pressure roll 32, preferably in a manner to minimized the unsupported sheet wrap angle a on the pressure roll 32. The unsupported sheet wrap angle α may range from 0 to about 90 degrees, from 0 to about 45 degrees, and from 0 to about 10 degrees. Additionally, lower unsupported sheet wrap angle α reduces the size of the vacuum zone required thereby reducing energy requirements for the vacuum generated in the pressure roll. The unsupported sheet wrap angle α is defined as the portion of the circumference of the pressure roll 32 (expressed in degrees) wrapped by the wet web 10 from the first contact point of the wet web 10 on the pressure roll 32 to the last contact point of the wet web 10 on the pressure roll 32 as the wet web 10 is transferred to the drying cylinder 30.

The heated drying cylinder 30 is equipped with a vapor hood or Yankee dryer hood 34. The resulting dried web 36 is drawn or conveyed from the heated drying cylinder 30 and removed without creping, after which it is reeled onto a roll 38. The angle at which the dried web 36 is pulled from the surface of the heated drying cylinder 30 is suitably about 80 to about 100 degrees, measured tangent to the surface of the heated drying cylinder 30 at the point of separation, although this may vary at different operating speeds.

An interfacial control mixture 40 may be applied to the surface of the rotating heated drying cylinder 30 in spray form from a spray boom 42. For example, the interfacial control mixture 40 may comprise a mixture of polyvinyl alcohol, sorbitol, and Hercules M1336 polyglycol applied in an aqueous solution having less than 5 percent solids by weight, at a dose of between 50 and 75 milligrams per square meter. The amount of adhesive compounds and release agents must be balanced to adhere the wet web 10 so that is does not go up into the hood 34 yet to permit the dried web 36 to be pulled off the heated drying cylinder 30 without creping.

Figure 3:
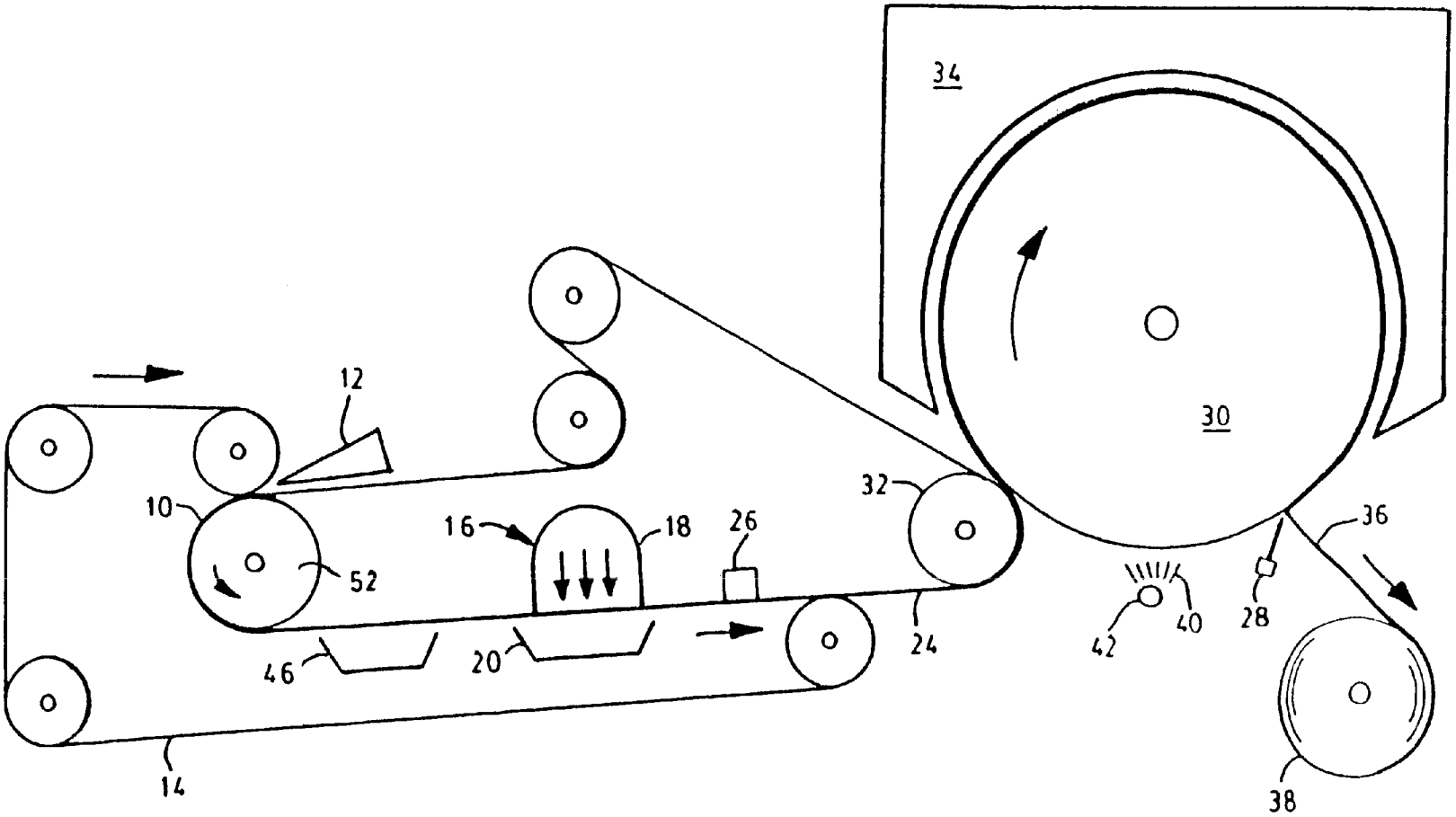
FIG. 3 representatively shows a schematic process flow diagram illustrating yet another alternative method according to the present invention.

Another alternative embodiment is shown in FIG. 3. This embodiment is similar to that of FIG. 2 except that the first fabric 14 is extended to act as the support fabric 22 shown in FIG. 2. This provides a potential reduction in capital cost and operating cost with the reduction in the number of fabrics required to modify this process. In the embodiment shown in FIG. 3, an embryonic wet web 10 formed as a slurry of papermaking fibers is deposited from a headbox 12 between an endless loop of a first fabric 14 and an endless loop of a second fabric 24. The second fabric 24 generally replaces the felt of the standard crescent-former tissue machine. At least one of the fabrics 14 and 24 may be a forming fabric, preferably the first fabric 14. In addition, at least one of the fabrics 14 and 24 may be a molding fabric, preferably the second fabric 24.

The embryonic wet web 10 is partially dewatered by the pressure due to the tension on first fabric 14 and the centrifugal force created as the wet web 10 passes around the forming roll 52 and further dewatered by an optional vacuum box 46 or other suitable devices while between the first fabric 14 and the second fabric 24. An air press 16 is used to non-compressively dewater the wet web 10 as it is sandwiched between the first fabric 14 and a second fabric 24. The illustrated air press 16 comprises an assembly of a pressurized air plenum 18 disposed in operable relation with a vacuum box 20. While passing through the air press 16, the wet web 10 is sandwiched between the second fabric 24 and the support fabric 22 with the support fabric 22 disposed between the wet web 10 and the vacuum box 20. (In alternative embodiments, the second fabric 24 may be disposed between the wet web 10 and the vacuum box 20).

The wet web 10 is then transferred with or without the assistance of the vacuum shoe 26 to the second fabric 24. The wet web 10 on the second fabric 24 is then pressed against a drying cylinder 30 by means of a pressure roll 32. The heated drying cylinder 30 is equipped with a vapor hood or Yankee dryer hood 34. The resulting dried web 36 is drawn or conveyed from the heated drying cylinder 30 and removed without creping, after which it is reeled onto a roll 38. The angle at which the dried web 36 is pulled from the surface of the heated drying cylinder 30 is suitably about 80 to about 100 degrees, measured tangent to the surface of the heated drying cylinder 30 at the point of separation, although this may vary at different operating speeds.

An interfacial control mixture 40 may be applied to the surface of the rotating heated drying cylinder 30 in spray form from a spray boom 42. For example, the interfacial control mixture 40 may comprise a mixture of polyvinyl alcohol, sorbitol, and Hercules M1336 polyglycol applied in an aqueous solution having less than 5 percent solids by weight, at a dose of between 50 and 75 milligrams per square meter. The amount of adhesive compounds and release agents must be balanced to adhere the wet web 10 so that is does not go up into the hood 34 yet to permit the dried web 36 to be pulled off the heated drying cylinder 30 without creping.

An air press 200 for dewatering the wet web 10 is shown in FIGS. 4–7. The air press 200 generally comprises an upper air plenum 202 in combination with a lower collection device 204 in the form of a vacuum box. The wet web 10 travels in a machine direction 205 between the air plenum 202 and vacuum box 204 while sandwiched between an upper support fabric 206 and a lower support fabric 208. The air plenum 202 and vacuum box 204 are operatively associated with one another so that pressurized fluid supplied to the air plenum 202 travels through the wet web 10 and is removed or evacuated through the vacuum box 204.

Each continuous fabrics 206 and 208 travels over a series of rolls (not shown) to guide, drive and tension the fabrics 206 and 208 in a manner known in the art. The fabric tension is set to a predetermined amount, suitably from about 10 to about 60 pounds per lineal inch (pli), particularly from about 30 to about 50 pli, and more particularly from about 35 to about 45 pli. The fabrics 206 and 208 that may be useful for transporting the wet web 10 through the air press 200 include almost any fluid permeable fabric, for example Albany International 94M, Appleton Mills 2164B, or the like.

Figure 4:
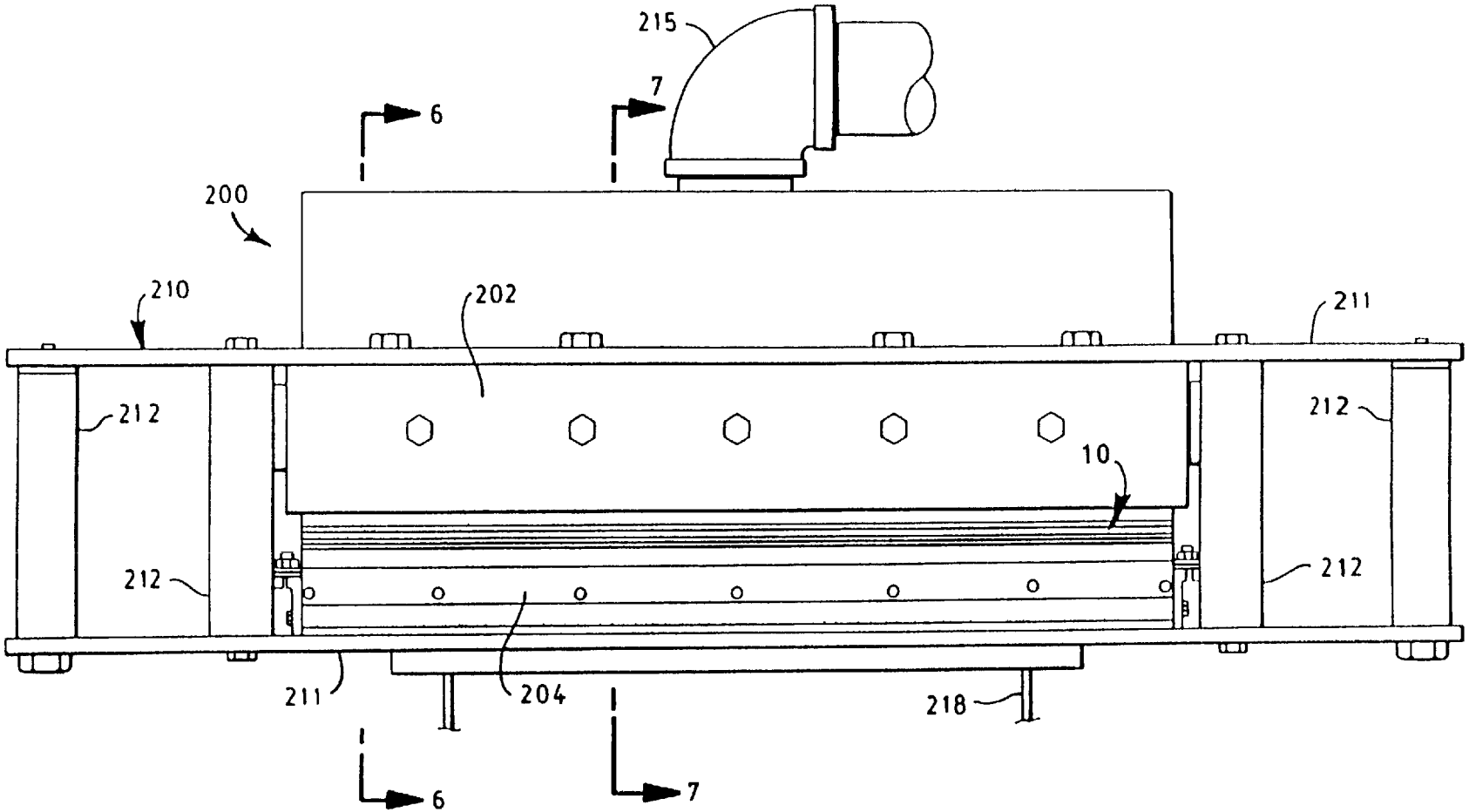
FIG. 4 representatively shows an enlarged end view of an air press for use in the methods of FIGS. 1–3, with an air plenum sealing assembly of the air press in a raised position relative to the wet web and vacuum box.
Figure 5:
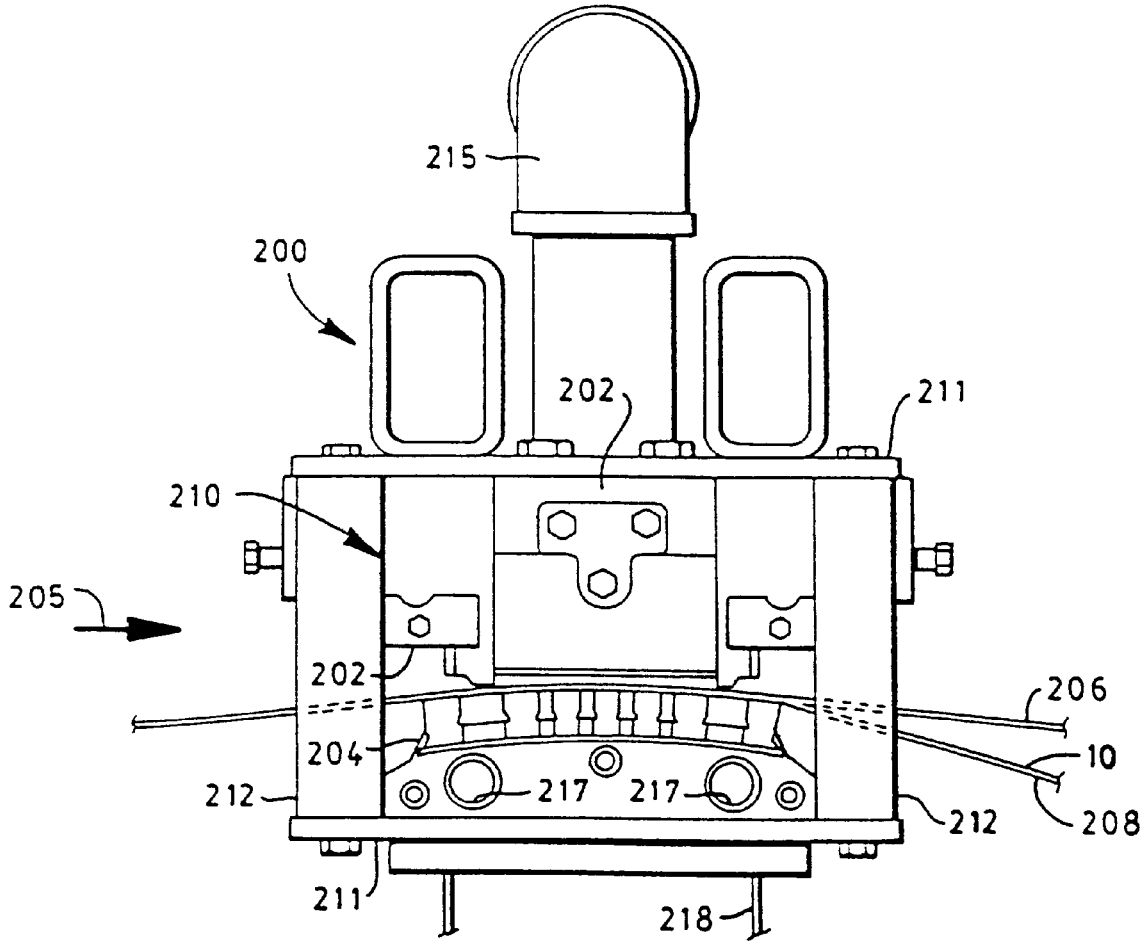
FIG. 5 representatively shows a side view of the air press of FIG. 4.

An end view of the air press 200 spanning the width of the wet web 10 is shown in FIG. 4, and a side view of the air press 200 in the machine direction 205 is shown in FIG. 5. In both FIGS. 4 and 5, several components of the air plenum 202 are illustrated in a raised or retracted position relative to the wet web 10 and the vacuum box 204. In the retracted position, effective sealing of pressurized fluid is not possible. For purposes of the present invention, a "retracted position" of the air press 200 means that the components of the air plenum 202 do not impinge upon the wet web 10 and support fabrics 206 and 208.

Figure 6:
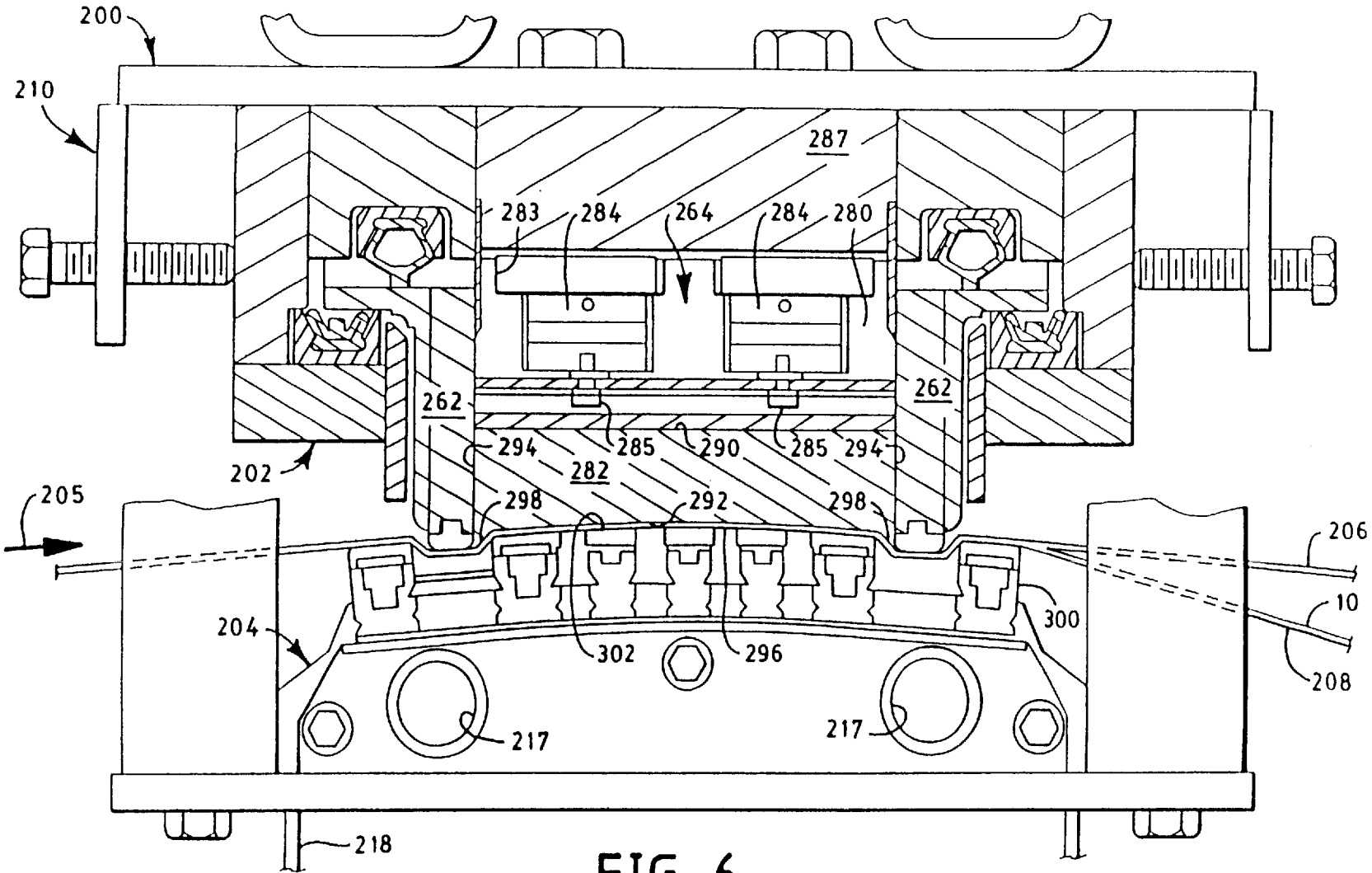
FIG. 6 representatively shows an enlarged section view taken generally from the plane of the line 6—6 in FIG. 4, but with the sealing assembly loaded against the fabrics.
Figure 7:
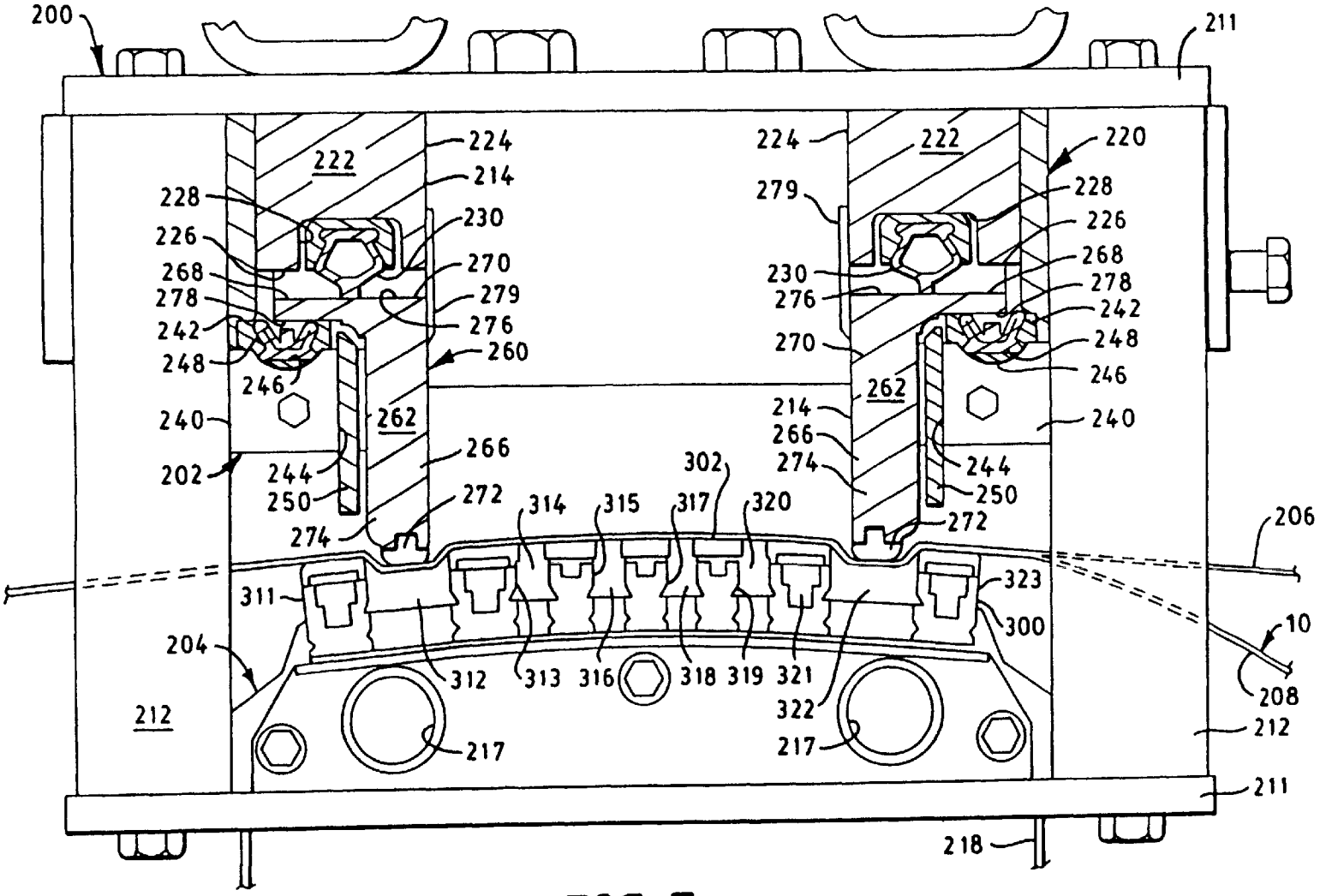
FIG. 7 representatively shows an enlarged section view similar to FIG. 6 but taken generally from the plane of the line 7—7 in FIG. 4.

The illustrated air plenum 202 and the vacuum box 204 are mounted within a suitable frame structure 210. The illustrated frame structure 210 comprises upper and lower support plates 211 separated by a plurality of vertically oriented support bars 212. The air plenum 202 defines a plenum chamber 214 (FIG. 7) that is adapted to receive a supply of pressurized fluid through one or more suitable air conduits 215 operatively connected to a pressurized fluid source (not shown). Correspondingly, the vacuum box 204 defines a plurality of vacuum chambers (described hereinafter in relation to FIG. 7) that are desirably operatively connected to low and high vacuum sources (not shown) by suitable fluid conduits 217 and 218, respectively (FIGS. 5, 6, and 7). The water removed from the wet web 10 is thereafter separated from the air streams. Various fasteners for mounting the components of the air press 200 are shown in the FIGS. 5, 6, and 7 but are not labeled.

Enlarged section views of the air press 200 are shown in FIGS. 6 and 7. In these FIGS. 6 and 7, the air press 200 is shown in an operating position wherein components of the air plenum 202 are lowered into an impingement relationship with the wet web 10 and support fabrics 206 and 208. The degree of impingement that has been found to result in proper sealing of the pressurized fluid with minimal contact force and therefore reduced fabric wear is described in greater detail hereinafter.

The air plenum 202 comprises both stationary components 220 that are fixedly mounted to the frame structure 210 and a sealing assembly 260 that is movably mounted relative to the frame structure 210 and the wet web 10. Alternatively, the entire air plenum 202 could be moveably mounted relative to a frame structure 210.

With particular reference to FIG. 7, the stationary components 220 of the air plenum 202 include a pair of upper support assemblies 222 that are spaced apart from one another and positioned beneath the upper support plate 211. The upper support assemblies 222 define facing surfaces 224 that are directed toward one another and that partially define therebetween the plenum chamber 214. The upper support assemblies 222 also define bottom surfaces 226 that are directed toward the vacuum box 204. In the illustrated embodiment, each bottom surface 226 defines an elongated recess 228 in which an upper pneumatic loading tube 230 is fixedly mounted. The upper pneumatic loading tubes 230 are suitably centered the cross-machine direction and desirably extend over the full width of the wet web 10.

The stationary components 220 of the air plenum 202 also include a pair of lower support assemblies 240 that are spaced apart from one another and vertically spaced from the upper support assemblies 222. The lower support assemblies 240 define top surfaces 242 and facing surfaces 244. The top surfaces 242 are directed toward the bottom surfaces 226 of the upper support assemblies 222 and, as illustrated, define elongated recesses 246 in which lower pneumatic loading tubes 248 are fixedly mounted. The lower pneumatic loading tubes 248 are suitably centered in the cross-machine direction and suitably extend over about 50 to 100 percent of the width of the wet web. In the illustrated embodiment, lateral support plates 250 are fixedly attached to the facing surfaces 244 of the lower support assemblies 240 and function to stabilize vertical movement of the sealing assembly 260.

Figure 8:
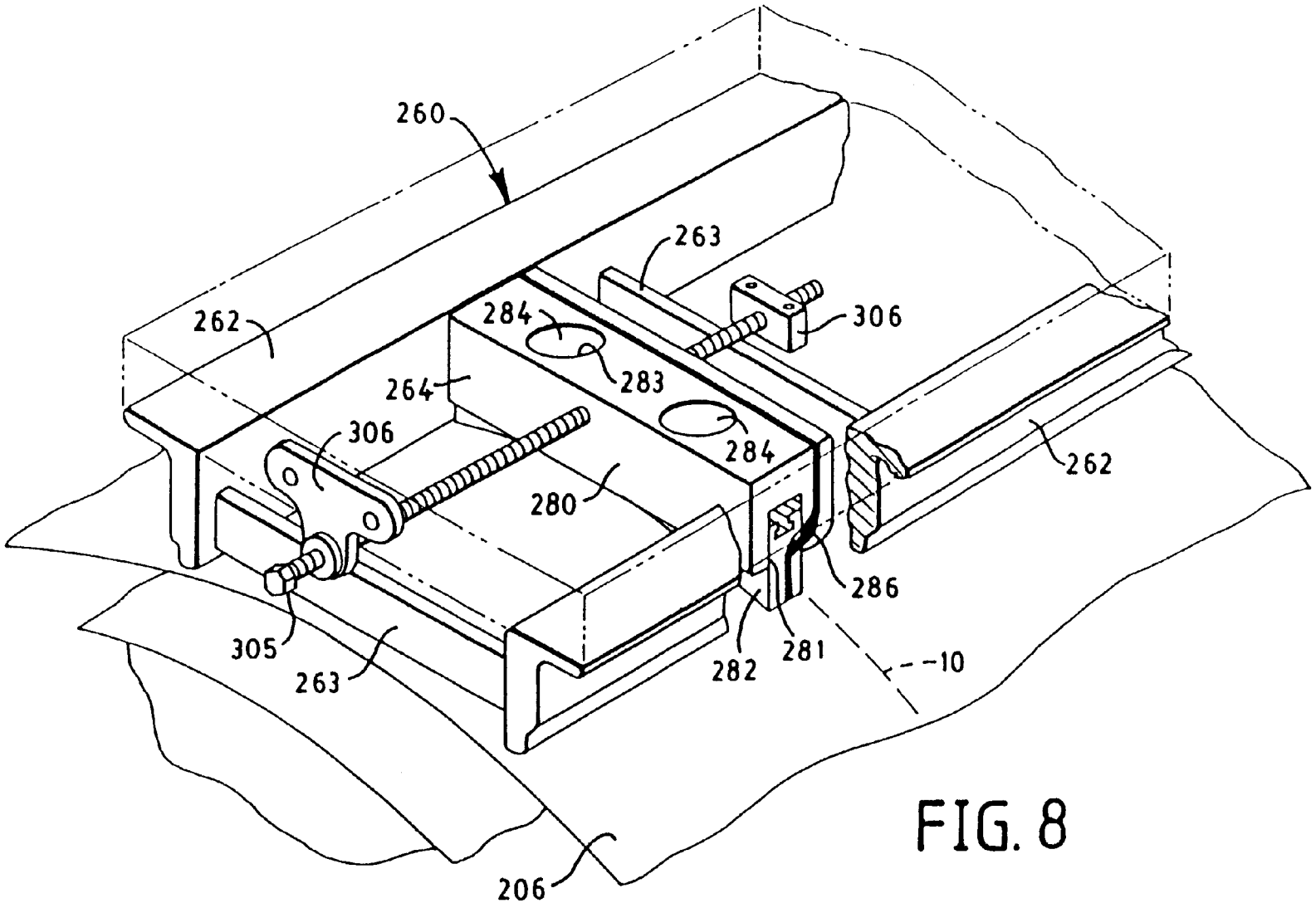
FIG. 8 representatively shows a perspective view of several components of the air plenum sealing assembly positioned against the fabrics, with portions broken away and shown in section for purposes of illustration.

With additional reference to FIG. 8, the sealing assembly 260 comprises a pair of cross-machine direction sealing members referred to as CD sealing members 262 (FIGS. 6–8) that are spaced apart from one another, a plurality of braces 263 (FIG. 8) that connect the CD sealing members 262, and a pair of machine direction sealing members referred to as MD sealing members 264 (FIGS. 6 and 8). The CD sealing members 262 are vertically moveable relative to the stationary components 220. The optional but desirable braces 263 are fixedly attached to the CD sealing members 262 to provide structural support, and thus move vertically along with the CD sealing members 262. In the machine direction 205, the MD sealing members 264 are disposed between the upper support assemblies 222 and between the CD sealing members 262. As described in greater detail hereinafter, portions of the MD sealing members 264 are vertically moveable relative to the stationary components 220. In the cross-machine direction, the MD sealing members 264 are positioned near the edges of the wet web 10. In one particular embodiment, the MD sealing members 264 are moveable in the cross-machine direction in order to accommodate a range of possible wet web widths.

The illustrated CD sealing members 262 include a main upright wall section 266, a transverse flange 268 projecting outwardly from a top portion 270 of the wall section, and a sealing blade 272 mounted on an opposite bottom portion 274 of the wall section 266 (FIG. 7). The outwardly-projecting flange 268 thus forms opposite, upper and lower control surfaces 276 and 278 that are substantially perpendicular to the direction of movement of the sealing assembly 260. The wall section 266 and flange 268 may comprise separate components or a single component as illustrated.

As noted above, the components of the sealing assembly 260 are vertically moveable between the retracted position shown in FIGS. 4 and 5 and the operating position shown in FIGS. 6 and 7. In particular, the wall sections 266 of the CD sealing members 262 are positioned inward of the position control plates 250 and are slideable relative thereto. The amount of vertical movement is determined by the ability of the transverse flanges 268 to move between the bottom surfaces 226 of the upper support assemblies 222 and the top surfaces 242 of the lower support assemblies 240.

The vertical position of the transverse flanges 268 and thus the CD sealing members 262 is controlled by activation of the pneumatic loading tubes 230 and 248. The loading tubes 230 and 248 are operatively connected to a pneumatic source and to a control system (not shown) for the air press. Activation of the upper loading tubes 230 creates a downward force on the upper control surfaces 276 of the CD sealing members 262 resulting in a downward movement of the flanges 268 until they contact the top surfaces 242 of the lower support assemblies 240 or are stopped by an upward force caused by the lower loading tubes 248 or the fabric tension. Retraction of the CD sealing members 262 is achieved by activation of the lower loading tubes 248 and deactivation of the upper loading tubes 230. In this case, the lower loading tubes 248 press upwardly on the lower control surfaces 278 and cause the flanges 268 to move toward the bottom surfaces of the upper support assemblies 222. Of course, the upper and lower loading tubes 230 and 248 can be operated at differential pressures to establish movement of the CD sealing members 262. Alternative means for controlling vertical movement of the CD sealing members 262 can comprise other forms and connections of pneumatic cylinders, hydraulic cylinders, screws, jacks, mechanical linkages, or other suitable means. Suitable loading tubes 230 and 248 are available from Seal Master Corporation of Kent, Ohio.

As shown in FIG. 7, a pair of bridge plates 279 span the gap between the upper support assemblies 222 and the CD sealing members 262 to prevent the escape of pressurized fluid. The bridge plates 279 thus define part of the air plenum chamber 214. The bridge plates 279 may be fixedly attached to the facing surfaces 224 of the upper support assemblies 222 and slideable relative to the inner surfaces of the CD sealing members 262, or vice versa. The bridge plates 279 may be formed of a fluid impermeable, semi-rigid, low-friction material such as LEXAN, sheet metal or the like.

The sealing blades 272 function together with other features of the air press 200 to minimize the escape of pressurized fluid between the air plenum 202 and the wet web 10 in the machine direction. Additionally, the sealing blades 272 are desirably shaped and formed in a manner that reduces the amount of fabric wear. In particular embodiments, the sealing blades 272 are formed of resilient plastic compounds, ceramic, coated metal substrates, or the like.

With particular reference to FIGS. 6 and 8, the MD sealing members 264 are spaced apart from one another and adapted to prevent the loss of pressurized fluid along the side edges of the air press 200. FIGS. 6 and 8 each show one of the MD sealing members 264, which are positioned in the cross-machine direction near the edge of the wet web 10. As illustrated, each MD sealing member 264 comprises a transverse support member 280, an end deckle strip 282 operatively connected to the transverse support member 280, and actuators 284 for moving the end deckle strip 282 relative to the transverse support member 280. The transverse support members 280 are normally positioned near the side edges of the wet web 10 and are generally located between the CD sealing members 262. As illustrated, each transverse support member 280 defines a downwardly directed channel 281 (FIG. 8) in which the end deckle strip 282 is mounted. Additionally, each transverse support member 280 defines circular apertures 283 in which the actuators 284 are mounted.

The end deckle strips 282 are vertically moveable relative to the transverse support members 280 due to the cylindrical actuators 284. The coupling members 285 (FIG. 6) link the end deckle strips 282 to the output shaft of the cylindrical actuators 284. The coupling members 285 may comprise an inverted T-shaped bar or bars so that the end deckle strips 282 may slide within the channel 281, such as for replacement.

As shown in FIG. 8, both the transverse support members 280 and the end deckle strips 282 define slots to house a fluid impermeable sealing strip 286, such as O-ring material or the like. The sealing strip 286 helps seal the air chamber 214 of the air press 200 from leaks. The slots in which the sealing strip 286 resides is desirably widened at the interface between the transverse support members 280 and the end deckle strips 282 to accommodate relative movement between those components.

A bridge plate 287 (FIG. 6) is positioned between the MD sealing members 264 and the upper support plate 211 and fixedly mounted to the upper support plate 211. The lateral portions of the air plenum chamber 214 (FIG. 7) are defined by the bridge plate 287. Sealing means such as a fluid impervious gasketing material is desirably positioned between the bridge plate 287 and the MD sealing members 264 to permit relative movement therebetween and to prevent the loss of pressurized fluid.

The actuators 284 suitably provide controlled loading and unloading of the end deckle strips 282 against the upper support fabric 206, independent of the vertical position of the CD sealing members 262. The load can be controlled exactly to match the necessary sealing force. The end deckle strips 282 can be retracted when not needed to eliminate all end deckle and fabric wear. Suitable actuators are available from Bimba Corporation. Alternatively, springs (not shown) may be used to hold the end deckle strips 282 against the upper support fabric 206 although the ability to control the position of the end deckle strips 282 may be sacrificed.

With reference to FIG. 6, each end deckle strip 282 has a top surface or edge 290 disposed adjacent to the coupling members 285, an opposite bottom surface or edge 292 that resides during use in contact with the upper support fabric 206, and the lateral surfaces or edges 294 that are in close proximity to the CD sealing members 262. The shape of the bottom surface 292 is suitably adapted to match the curvature of the vacuum box 204. Where the CD sealing members 262 impinge upon the fabrics 206 and 208, the bottom surface 292 is desirably shaped to follow the curvature of the fabric impingement. Thus, the bottom surface 292 has a central portion 296 that is laterally surrounded in the machine direction by spaced apart end portions 298. The shape of the central portion 296 generally tracks the shape of the vacuum box 204 while the shape of the end portions 298 generally tracks the deflection of the fabrics 206 and 208 caused by the CD sealing members 262. To prevent wear on the projecting end portions 298, the end deckle strips 282 are desirably retracted before the CD sealing members 262 are retracted. The end deckle strips 282 are desirably formed of a gas impermeable material that minimizes fabric wear. Particular materials that may be suitable for the end deckle strips 282 include polyethylene, nylon, or the like.

The MD sealing members 264 are desirably moveable in the cross-machine direction and are thus desirably slideably positioned against the CD sealing members 262. In the illustrated embodiment, movement of the MD sealing members 264 in the cross-machine direction is controlled by a threaded shaft or bolt 305 that is held in place by brackets 306 (FIG. 8). The threaded shaft 305 passes through a threaded aperture in the transverse support member 280 and rotation of the shaft causes the MD sealing member to move along the shaft. Alternative means for moving the MD sealing members 264 in the cross-machine direction such as pneumatic devices or the like may also be used. In one alternative embodiment, the MD sealing members 264 are fixedly attached to the CD sealing members 262 so that the entire sealing assembly 260 is raised and lowered together (not shown). In another alternative embodiment, the transverse support members 280 are fixedly attached to the CD sealing members 262 and the end deckle strips 282 are adapted to move independently of the CD sealing members 262 (not shown).

The vacuum box 204 comprises a vacuum box cover 300 having a top surface 302 over which the lower support fabric 208 travels. The vacuum box cover 300 and the sealing assembly 260 are desirably gently curved to facilitate web control. The illustrated vacuum box cover 300 is formed, from the leading edge to the trailing edge in the machine direction 205 ,with a first exterior sealing shoe 311, a first sealing vacuum zone 312, a first interior sealing shoe 313, a series of four high vacuum zones 314, 316, 318, and 320 surrounding three interior shoes 315, 317,and 319, a second interior sealing shoe 321, a second sealing vacuum zone 322, and a second exterior sealing shoe 323 (FIG. 7). Each of these sealing shoes 315, 317, and 319 and vacuum zones 314, 316, 318, and 320 desirably extend in the cross-machine direction across the full width of the web. The shoes 315, 317, and 319 each include a top surface desirably formed of a ceramic material to ride against the lower support fabric 208 without causing significant fabric wear. Suitable vacuum box covers and shoes may be formed of plastics, NYLON, coated steels or the like, and are available from JWI Corporation or IBS Corporation.

The four high vacuum zones 314, 316, 318, and 320 are passageways in the cover 300 that are operatively connected to one or more vacuum sources (not shown) that draw a relatively high vacuum level. For example, the high vacuum zones 314, 316, 318, and 320 may be operated at a vacuum of 0 to 25 inches of mercury vacuum, and more particularly about 10 to about 25 inches of mercury vacuum. As an alternative to the illustrated passageways, the cover 300 could define a plurality of holes or other shaped openings (not shown) that are connected to a vacuum source to establish a flow of pressurized fluid through the web. In one embodiment, the high vacuum zones 314, 316, 318,and 320 comprise slots each measuring 0.375 inch in the machine direction and extending across the full width of the wet web. The dwell time that any given point on the web is exposed to the flow of pressurized fluid, which in the illustrated embodiment is the time over slots 314, 316, 318 and 320, is suitably about 10 milliseconds or less, particularly about 7.5 milliseconds or less, more particularly 5 milliseconds or less, such as about 3 milliseconds or less or even about 1 millisecond or less. The number and width of the high pressure vacuum slots 314, 316, 318, and 320 and the machine speed determine the dwell time. The selected dwell time will depend on the type of fibers contained in the wet web and the desired amount of dewatering.

The first and second sealing vacuum zones 312 and 322 may be employed to minimize the loss of pressurized fluid from the air press 200. The sealing vacuum zones 312 and 322 are passageways in the cover 300 that may be operatively connected to one or more vacuum sources (not shown) that desirably draw a relatively lower vacuum level as compared to the four high vacuum zones 314, 316, 318, and 320. Specifically, the amount of vacuum that is desirable for the sealing vacuum zones is 0 to about 100 inches water column, vacuum.

The air press 200 is desirably constructed so that the CD sealing members 262 are disposed within the sealing vacuum zones 312 and 322. More specifically, the sealing blade 272 of the CD sealing member 262 that is on the leading side of the air press 200 is disposed between, and more particularly centered between, the first exterior sealing shoe 311 and the first interior sealing shoe 313, in the machine direction. The trailing sealing blade 272 of the CD sealing member 262 is similarly disposed between, and more particularly centered between, the second interior sealing shoe 321 and the second exterior sealing shoe 323, in the machine direction. As a result, the sealing assembly 260 can be lowered so that the CD sealing members 262 deflect the normal course of travel of the wet web 10 and fabrics 206 and 208 toward the vacuum box 204, which is shown in slightly exaggerated scale in FIG. 7 for purposes of illustration.

The sealing vacuum zones 312 and 322 function to minimize the loss of pressurized fluid from the air press 200 across the width of the wet web 10. The vacuum in the sealing vacuum zones 312 and 322 draws pressurized fluid from the air plenum 202 and draws ambient air from outside the air press 200. Consequently, an air flow is established from outside the air press 200 into the sealing vacuum zones 312 and 322 rather than a pressurized fluid leak in the opposite direction. Due to the relative difference in vacuum between the high vacuum zones 314, 316, 318, and 320 and the sealing vacuum zones 312 and 322, though, the vast majority of the pressurized fluid from the air plenum 202 is drawn into the high vacuum zones 314, 316, 318, and 320 rather than the sealing vacuum zones 312 and 322.

Figure 9:
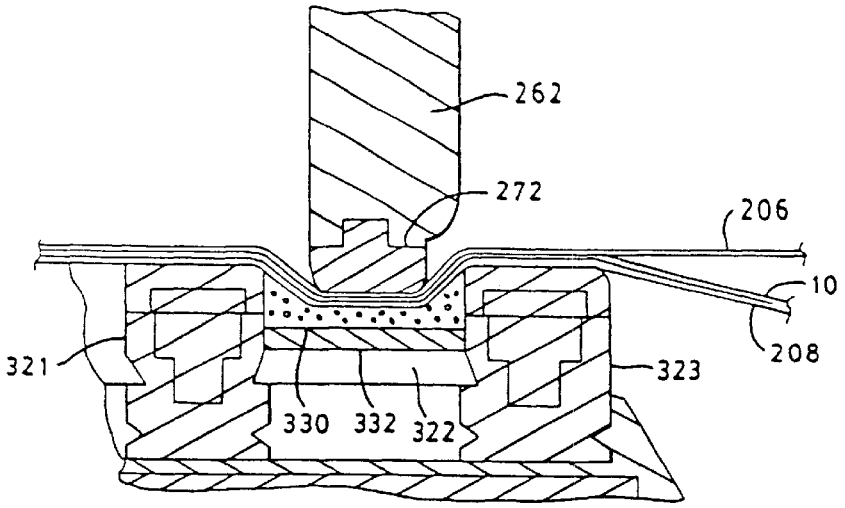
FIG. 9 representatively shows an enlarged section view of an alternative sealing configuration for the air press of FIG. 4.

In an alternative embodiment which is partially illustrated in FIG. 9, no vacuum is drawn in either or both of the sealing vacuum zones 312 and 322. Rather, deformable sealing deckles 330 are disposed in the sealing vacuum zones 312 and 322 (only sealing zone 322 is shown) to prevent leakage of pressurized fluid in the machine direction. In this case, the air press 200 is sealed in the machine direction by the sealing blades 272 that impinge upon the fabrics 206 and 208 and the wet web 10 and by the fabrics 206 and 208 and the wet web 10 being displaced in close proximity to or contact with the deformable sealing deckles 330. This configuration, where the CD sealing members 262 impinge upon the fabrics 206 and 208 and wet web 10 and the CD sealing members 262 are opposed on the other side of the fabrics 206 and 208 and the wet web 10 by deformable sealing deckles 330, has been found to produce a particularly effective air plenum seal.

The deformable sealing deckles 330 desirably extend across the full width of the wet web 10 to seal the leading end, the trailing end, or both the leading and the trailing end of the air press 200. The sealing vacuum zone 312 and 322 may be disconnected from the vacuum source when the deformable sealing deckle 330 extends across the full web width. Where the trailing end of the air press 200 employs a full width deformable sealing deckle 330, a vacuum device or blow box may be employed downstream of the air press 200 to cause the web 10 to remain with one of the fabrics 206 or 208 as the fabrics 206 and 208 are separated.

The deformable sealing deckles 330 desirably either comprise a material that preferentially wears relative to the fabric 208, meaning that when the fabric 208 and the material are in use the material will wear away without causing significant wear to the fabric 208, or comprise a material that is resilient and that deflects with impingement of the fabric 208. In either case, the deformable sealing deckles 330 are desirably gas impermeable, and desirably comprise a material with high void volume, such as a closed cell foam or the like. In one particular embodiment, the deformable sealing deckles 330 comprise a closed cell foam measuring 0.25 inch in thickness. Most desirably, the deformable sealing deckles 330 themselves become worn to match the path of the fabrics 206 and 208. The deformable sealing deckles 330 are desirably accompanied by a backing plate 332 for structural support, for example an aluminum bar.

In embodiments where full width sealing deckles 330 are not used, sealing means of some sort are required laterally of the web. Deformable sealing deckles 330 as described above, or other suitable means known in the art, may be used to block the flow of pressurized fluid through the fabrics 206 and 208 laterally outward of wet web 10.

The degree of impingement of the CD sealing members 262 into the upper support fabric 206 uniformly across the width of the wet web 10 has been found to be a significant factor in creating an effective seal across the web. The requisite degree of impingement has been found to be a function of the maximum tension of the upper and lower support fabrics 206 and 208, the pressure differential across the web and in this case between the air plenum chamber 214 and the sealing vacuum zones 312 and 322, and the gap between the CD sealing members 262 and the vacuum box cover 300.

Figure 10:
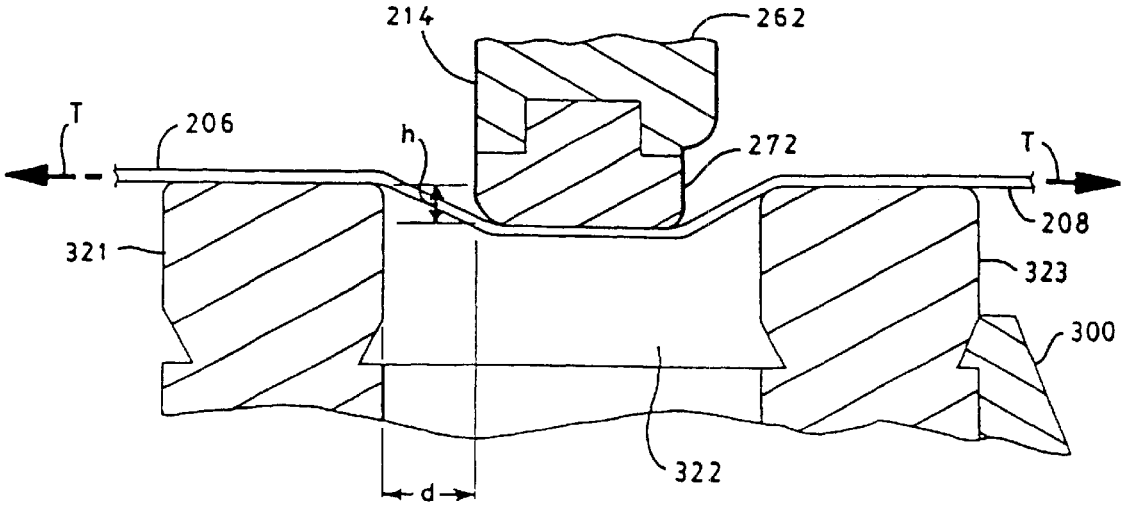
FIG. 10 representatively shows an enlarged schematic diagram of a sealing section of the air press of FIG. 4.

With additional reference to the schematic diagram of the trailing sealing section of the air press 200 shown in FIG. 10, the minimum desirable amount of impingement of the CD sealing member 262 into the upper support fabric 206, h(min), has been found to be represented by the following equation:

$$h(\min) = \frac{T}{W}\left(\cosh\left(\frac{Wd}{T}\right) - 1\right);$$

where:

T is the tension of the fabrics measured in pounds per inch;

W is the pressure differential across the web measured in psi; and d is the gap in the machine direction measured in inches.

FIG. 10 shows the trailing CD sealing member 262 deflecting the upper support fabric 206 by an amount represented by arrow "h". The maximum tension of the upper and lower support fabrics 206 and 208 is represented by arrow "T". The fabric tension can be measured by a model tensometer available from Huyck Corporation or other suitable methods. The gap between the sealing blade 272 of the CD sealing member 262 and the second interior sealing shoe 321 measured in the machine direction 205 and represented by arrow "d". The gap "d" of significance for the determining impingement is the gap on the higher pressure differential side of the sealing blade 272, that is, toward the plenum chamber 214, because the pressure differential on that side has the most effect on the position of the fabrics 206 and 208 and the web 10. Desirably, the gap between the sealing blade 272 and the second exterior shoe 323 is approximately the same or less than gap "d".

Adjusting the vertical placement of the CD sealing members 262 to the minimum degree of impingement as defined above is a determinative factor in the effectiveness of the CD seal. The loading force applied to the sealing assembly 260 plays a lesser role in determining the effectiveness of the seal, and need only be set to the amount needed to maintain the requisite degree of impingement. Of course, the amount of fabric wear will impact the commercial usefulness of the air press 200. To achieve effective sealing without substantial fabric wear, the degree of impingement is desirably equal to or only slightly greater than the minimum degree of impingement as defined above. To minimize the variability of fabric wear across the width of the fabrics, the force applied to the fabric is desirably kept constant over the cross machine direction. This can be accomplished with either controlled and uniform loading of the CD sealing members 262 or controlled position of the CD sealing members 262 and uniform geometry of the impingement of the CD sealing members 262.

In use, a control system causes the sealing assembly 260 of the air plenum 202 to be lowered into an operating position. First, the CD sealing members 262 are lowered so that the sealing blades 272 impinge upon the upper support fabric 206 to the degree described above. More particularly, the pressures in the upper and lower loading tubes 230 and 248 are adjusted to cause downward movement of the CD sealing members 262 until movement is halted by the transverse flanges 268 contacting the lower support assemblies 240 or until balanced by fabric tension. Second, the end deckle strips 282 of the MD sealing members 264 are lowered into contact with or close proximity to the upper support fabric 206. Consequently, the air plenum 202 and the vacuum box 204 are both sealed against the wet web 10 to prevent the escape of pressurized fluid.

The air press 200 is then activated so that pressurized fluid fills the air plenum 202 and an air flow is established through the web 10. In the embodiment illustrated in FIG. 7, high and low vacuums are applied to the high vacuum zones 314, 316, 318, and 320 and the sealing vacuum zones 312 and 322 to facilitate air flow, sealing and water removal. In the embodiment of FIG. 9, pressurized fluid flows from the air plenum 202 to the high vacuum zones 314, 316, 318, and 320 and the deformable sealing deckles 330 seal the air press 200 in the cross machine direction. The resulting pressure differential across the wet web 10 and resulting air flow through the web 10 provide for efficient dewatering of the web 10.

A number of structural and operating features of the air press 200 contribute to very little pressurized fluid being allowed to escape in combination with a relatively low amount of fabric wear. Initially, the air press 200 uses the CD sealing members 262 that impinge upon the fabrics 206 and 208 and the wet web 10. The degree of impingement is determined to maximize the effectiveness of the CD seal. In one embodiment, the air press 200 utilizes the sealing vacuum zones 312 and 322 to create an ambient air flow into the air press 200 across the width of the wet web 10. In another embodiment, deformable sealing deckles 330 are disposed in the sealing vacuum zones 312 and 322 opposite the CD sealing members 262. In either case, the CD sealing members 262 are desirably disposed at least partly in passageways of the vacuum box cover 300 in order to minimize the need for precise alignment of mating surfaces between the air plenum 202 and the vacuum box 204. Further, the sealing assembly 260 can be loaded against a stationary component such as the lower support assemblies 240 that are connected to the frame structure 210. As a result, the loading force for the air press 200 is independent of the pressurized fluid pressure within the air plenum 202. The fabric wear is also minimized due to the use of low fabric wear materials and lubrication systems. Suitable lubrication systems may include chemical lubricants such as emulsified oils, debonders or other like chemicals, or water. Typical lubricant application methods include a spray of diluted lubricant applied in a uniform manner in the cross machine direction, an hydraulically or air atomized solution, a felt wipe of a more concentrated solution, or other methods well known in spraying system applications.

Observations have shown that the ability to run at higher pressure plenum pressures depends on the ability to prevent leaks. The presence of a leak can be detected from excessive air flows relative to previous or expected operation, additional operating noise, sprays of moisture, and in extreme cases, regular or random defects in the wet web including holes and lines. The leaks can be repaired by the alignment or adjustment of the air press sealing components.

In the air press 200, uniform air flows in the cross-machine direction are desirable to provide uniform dewatering of a web 10. Cross-machine direction flow uniformity may be improved with mechanisms such as tapered ductwork on the pressure and vacuum sides, shaped using computational fluid dynamic modeling. Because web basis weight and moisture content may not be uniform in the cross-machine direction, is may be desirably to employ additional means to obtain uniform air flow in the cross-machine direction, such as independently-controlled zones with dampers on the pressure or vacuum sides to vary the air flow based on sheet properties, a baffle plate to take a significant pressure drop in the flow before the wet web, or other direct means. Alternative methods to control CD dewatering uniformity may also include external devices, such as zoned controlled steam showers, for example a Devronizer steam shower available from Honeywell-Measurex Systems Inc. of Dublin, Ohio or the like.

EXAMPLES

The following examples are provided to give a more detailed understanding of the invention. The particular amounts, proportions, compositions and parameters are meant to be exemplary, and are not intended to specifically limit the scope of the invention.

Example 1

A 12-inch wide tissue was produced on an experimental tissue machine, having a fabric width of 22 inches, from a fibrous slurry comprised of an unrefined 50:50 fiber blend of bleached kraft northern softwood fibers and bleached kraft eucalyptus fibers. The tissue was formed using a stratified, three-layer headbox with the slurry being deposited from each stratum to form a blended sheet having a nominal basis weight of 19 gsm. The headbox injected the slurry between two Lindsay Wire 2164B forming fabrics, in a twin wire forming section, with a suction roll former. To control strength, 1000 ml/minute of Parez 631 NC at 6 percent solids was added to the stock prior to the forming process.

While disposed between the two forming fabrics and traveling at 1000 feet per minute (fpm), the embryonic wet web was transported over four vacuum boxes operating with respective vacuum pressures of approximately 11, 14, 13 and 19 inches of mercury vacuum. The embryonic wet web, still contained between the two forming fabrics, passed through an air press including an air plenum and a collection box that were operatively associated and integrally sealed with one another. The air plenum was pressurized with air at approximately 150 degrees Fahrenheit to 15 pounds per square inch gauge, and the collection box was operated at approximately 11 inches of mercury vacuum. The wet web was exposed to the resulting pressure differential of approximately 41.5 inches of mercury and air flow of 68 SCFM per square inch for a dwell time of 7.5 milliseconds over four slots, each ⅜" in length. The consistency of the wet web was approximately 30 percent just prior to the air press and 39 percent upon exiting the air press.

The dewatered wet web was then transferred using a vacuum pickup shoe operating at approximately 10 inches of mercury vacuum onto a three-dimensional fabric, a Lindsay Wire T-216-3 TAD fabric. A silicon emulsion in water was sprayed onto the sheet side of the T-216-3 fabric just prior to transfer from the forming fabric to facilitate the eventual transfer to the Yankee dryer. The silicone was applied at a flow rate of 400 ml/minute at 1.0% solids. The TAD fabric was thereafter pressed against the surface of a Yankee dryer with a conventional pressure roll operating at a maximum pressing pressure of 350 pli. The fabric was wrapped over about 39 inches of the Yankee dryer surface by a transfer roll which was unloaded and slightly removed from the Yankee dryer.

The wet web was adhered to the Yankee dryer using an adhesive mixture of polyvinyl alcohol AIRVOL 523 made by Air Products and Chemical Inc. and sorbitol in water applied by four #6501 spray nozzles by Spraying Systems Company operating at approximately 40 psig with a flow rate of about 0.4 gallons per minute (gpm). The spray had a solids concentration of about 0.5 weight percent. The dried web was creped from the Yankee dryer at a final dryness of approximately 92% consistency and wound on a core. The product was then converted into 2-ply bathroom tissue using standard techniques. Results obtained for Example 1 are shown below in Table 1.

TABLE 1

| Test | Units | Example 1 Invention (Creped) | Example 2 Invention (Uncreped) | Example 3 (Comparative) | Example 4 (Comparative) |
|---|---|---|---|---|---|
| Roll Firmness | 0.001" | 104 | 140 | 134 | 178 |
| Roll Diameter | Mm | 126 | 128 | 125 | 125 |
| Sheet Count | | 253 | 180 | 280 | 198 |
| Core OD | Mm | 40 | 40 | 46 | 46 |
| Caliper (2 kPa, 8 plies) | Microns | 1667 | 2402 | 1288 | 1719 |
| MD Strength | g/3" | 1739 | 1911 | 2285 | 1719 |
| MD Stretch | | 14 | 13 | 22 | 15 |
| CD Strength | g/3" | 972 | 1408 | 718 | 700 |
| GMT | g/3" | 1300 | 1640 | 1281 | 1097 |
| Bone Dry Roll Weight | G | 133 | 95 | 158 | 106 |
| Bone Dry Basis Weight | $g/m^2$ | 19.1 | 18.8 | 20.6 | 20.4 |
| Absorbent Capacity | G | 97.4 | 117.2 | 79.0 | 97.0 |
| Absorbent Capacity | g ($h_2$0)/g (fiber) | 11.8 | 14.1 | 10.8 | 11.0 |

Example 2

A 12-inch wide tissue was produced on an experimental tissue machine, having a fabric width of 22 inches, from a fibrous slurry comprised of an unrefined 50:50 fiber blend of bleached kraft northern softwood fibers and bleached kraft eucalyptus fibers. The tissue was formed using a stratified, three-layer headbox with the slurry being deposited from each stratum to form a blended sheet having a nominal basis weight of 19 gsm. The headbox injected the slurry between two Lindsay Wire 2164B forming fabrics, in a twin wire forming section, with a suction roll former. To control strength, 1000 ml/minute of Parez 631 NC at 6 percent solids was added to the stock prior to the forming process.

While disposed between the two forming fabrics and traveling at 1000 feet per minute (fpm), the embryonic wet web was transported over four vacuum boxes operating with respective vacuum pressures of approximately 11, 14, 13 and 19 inches of mercury vacuum. The embryonic wet web, still contained between the two forming fabrics, passed through an air press including an air plenum and a collection box that were operatively associated and integrally sealed with one another. The air plenum was pressurized with air at approximately 150 degrees Fahrenheit to 15 pounds per square inch gauge, and the collection box was operated at 11 inches of mercury vacuum. The wet web was exposed to the resulting pressure differential of approximately 41.5 inches of mercury and air flow of 68 SCFM per square inch for a dwell time of 7.5 milliseconds over four slots, each with ⅜" length. The consistency of the wet web was approximately 30 percent just prior to the air press and 39 percent upon exiting the air press.

The dewatered wet web was then rush transferred using a vacuum pickup shoe operating at approximately 10 inches of mercury onto a three-dimensional fabric, a Lindsay Wire T-216-3 TAD fabric, traveling 20% percent slower than the forming fabrics. A silicone emulsion in water was sprayed onto the sheet side of the T-216-3 fabric just prior to transfer from the forming fabric to facilitate the eventual transfer to the Yankee dryer. The TAD fabric was thereafter pressed against the surface of a Yankee dryer with a conventional pressure roll operating at a maximum pressing pressure of 350 pli. The fabric was wrapped over about 39 inches of the Yankee dryer surface by a transfer roll which was unloaded and slightly removed from the Yankee dryer.

The wet web was adhered to the Yankee in a controlled manner using an interfacial control mixture comprised, on a percent active solids basis, of approximately 26 percent polyvinyl alcohol, 46 percent sorbitol, and 28 percent of Hercules M 1336 polyglycol applied at a dose of between 50 and 75 mg/m$^2$. The compounds were prepared in an aqueous solution having less than 5 percent solids by weight. The wet web was dried on the Yankee dryer to approximately 90% consistency and then "peeled" from the Yankee dryer by applying sufficient winding tension to remove the dried web just prior to the creping blade. The dried web was then wound on a core without additional pressing. The product was then converted into 2-ply bathroom tissue using standard techniques. Results obtained for Example 2 are shown above in Table 1.

Example 3

(Comparative)

A wet web was formed from a 50:40:10 blend of bleached kraft northern softwood, bleached kraft eucalyptus and softwood BCTMP fibers using a Fourdrinier former operating at approximately 3500 fpm. The resulting wet web at a basis weight of approximately 20 gsm was transferred from the forming fabric to a standard wet-press felt (using a couch roll). The wet web was carried to a 15 foot Yankee dryer and transferred to the Yankee dryer using standard techniques. The wet web was dried on the Yankee dryer using standard techniques and removed from the dryer at approximately 95% consistency using a creping blade.

To further increase the caliper, the web was transferred over an open draw to a second Yankee dryer (this dryer operating without the normal hood) and adhered to the Yankee dryer using a Latex adhesive. The wet web was then creped again and wound on a core. The product was then converted into 2-ply bathroom tissue using standard techniques. The process used in this example is known as the single re-creped process U.K. patent documents GB 2179949 B, GB 2152961 A, and GB 2179953 B, which are incorporated herein by reference. Results obtained for Example 3 are shown above in Table 1.

Example 4

(Comparative)

A wet web was formed from a 65:35 blend of bleached kraft northern softwood and bleached kraft eucalyptus fibers. The wet web was formed using a twin wire former in a layered configuration with the eucalyptus on the outside (air side) of the wet web. The wet web was dewatered to a consistency of approximately 27 percent using conventional vacuum dewatering technology and then throughdried using standard technology to a consistency of approximately 90 percent. The wet web was then transferred to a Yankee dryer, adhered using PVA as the adhesive, and dried to a consistency of 97 percent. The dried web was then wound on a core. The product was then converted into 2-ply bathroom tissue using standard techniques. Results obtained for Example 4 are shown below in Table 1.

The data of Table 1 clearly shows the improvement in sheet/roll properties that can be achieved using this invention. In the creped form (Example 1), the product of this invention yielded bath tissue that exhibited higher sheet caliper, 1667 microns versus 1288, than that of the control (Example 3) despite the additional re-creping step employed specifically to increase the bulk of the control. Without this re-creping step, the difference would be even larger, as the re-creping step typically adds about 30% more caliper. From the standpoint of roll properties, this additional caliper allowed the removal of 27 sheets (from 280 count to 253 count) while maintaining the same roll diameter. In fact, the rolls produced using this invention were firmer at the same roll diameter (104 versus 134 with lower numbers indicating greater firmness) despite the reduction in sheet count. Considered as a whole, the invention allowed a reduction in roll weight from 158 grams to 133 grams (16%) while producing superior roll properties.

The improvement in roll properties is even more striking when the uncreped example (Example 2) is considered. Here the sheet count was reduced to 180 sheets (again versus 280 for the control) while maintaining roll diameter and firmness. In this case the roll weight was reduced by 40%.

Alternately, the product of this invention was compared to creped throughdried, the product described in Example 4. It is clear the products have roughly equal properties in terms of roll bulk etc. In fact, the throughdried example showed a relatively low firmness, indicating the product of this invention is even better than that of the throughdried process.

Example 5

A wet web was formed from a fiber blend of 50:30:20 southern bleached kraft pine, bleached kraft northern softwood, and bleached kraft eucalyptus on an experimental tissue machine running approximately 50 fpm. The resulting wet web, at an approximate basis weight of 41 grams per meter square, was carried on the forming fabric and then transferred to a T-216-3 molding fabric. At the transfer point, the embryonic wet web was passed through an air press including an air plenum and a collection box that were operatively associated and (integrally) sealed with one another. At this point, the wet web was dewatered from the post forming consistency of approximately 10% to 32–35% consistency. The wet web was then carried to a Yankee dryer where it was transferred to the Yankee dryer, adhered using polyvinyl alcohol applied using standard spray nozzles and dried to 55% consistency. The web was then transferred to afterdriers for final drying and wound on a core. The resulting dried web was then embossed using a butterfly embossing pattern to obtain the final one-ply towel product. Results obtained for Example 5 are shown below in Table 2.

Example 6

A fiber blend of 65:35 bleached kraft southern softwood and softwood BCTMP was

| Test | Units | Example 5 Invention | Example 6 (Comparative) |
|---|---|---|---|
| Roll Firmness | inches | 0.191 | 0.277 |
| Roll Diameter | inches | 5.3 | 5.0 |
| Sheet Count | | 80 | 85 |
| Core OD | mm | 42 | 37 |
| Caliper - 10 sheet | inches | 0.252 | 0.195 |
| MD Strength | g/3" | 2934 | 2750 |
| MDStretch | | 13.2 | 7.8 |
| CD Strength | g/3" | 1420 | 1086 |
| CDStretch | | 8.1 | 7.3 |
| GMT | g/3" | 2041 | 1728 |
| As Is Basis Weight | g/m$^2$ | 41.3 | 50.9 |
| Absorbent Capacity | g | 2.56 | 1.73 |
| Absorbent Capacity | g ($h_2$0)/g (fiber) | 5.86 | 3.54 |

formed into a wet web at a machine speed of 250 fpm using a Fourdrinier style former. The resulting wet web, at an approximate basis weight of 50 grams per square meter, was transferred to a standard wet-pressing felt and conveyed to a Yankee dryer. The wet web was transferred to the Yankee dryer at a pressure roll nip using standard wet-pressing techniques. The wet web was adhered to the dryer using polyvinyl alcohol and creped at approximately 55 percent consistency. The dried web was then conveyed over an open draw to a series of can dryers where it was dried to approximately 95 percent consistency and wound on a core. The product was then converted into 1-ply towels using standard techniques. Results obtained for Example 6 are shown below in Table 2.

Table 2 clearly shows the product advantages inherent to this invention. The paper towels produced using this invention have superiority to the heavy wet-creped control in terms of caliper and absorbency despite a 19% reduction in basis weight. Additionally, the product of this invention has higher CD stretch which gives the towel added "toughness" in use. As finished product, the rolls produced using this invention were of higher diameter (5.3 inches vs. 5.0) and more firm (0.191 vs. 0.277). Again this was accomplished despite a 19% reduction in roll weight since sheet size and count were fixed.

Example 7

A wet web was formed using a fiber blend of 50:50 bleached kraft northern softwood and bleached kraft eucalyptus using the forming equipment and configuration described in Example 1. In this case, the machine speed was 2500 fpm. The resulting wet web, at an approximate basis weight of 20 pounds/2880 ft2, was passed through four vacuum boxes at 19.8, 19.8, 22.6, and 23.6 inches of mercury, respectively. The resulting wet web was then sent through the additional integrally-sealed dewatering system also described in Example 1. The air press was set to maintain a pressure of 15 psig in the plenum and pre and post air press samples were taken for consistency measurement. Results obtained for Example 7 are shown below in Table 3.

Example 8

The experiment of Example 7 was repeated except this time the air press was reconfigured to eliminate the integral seal between the air press plenum and the associated collection box. Specifically, the sealing load and hence the impingement of the cross-machine sealing blades was reduced until a leak between the plenum and the collection box became apparent. At this point, the air press plenum/collection box arrangement was set to a nominal 0.1 inch gap, though it was not possible to actually see the spacing between the plenum and the box as it was occupied by the fabrics and the wet web. The air flow to the plenum increased to the maximum obtainable from the compressor and a post dewatering consistency sample taken. Results obtained for Example 8 are shown below in Table 3.

TABLE 3

| Test | Units | Example 7 | Example 8 (Comparative) |
|---|---|---|---|
| Post Dewatering Consistency | % | 34.2 | 32.1 |
| Pre Dewatering Consistency | % | 26.8 | 26.8 |
| Water Removed | lb. water/lb. fiber | 0.81 | 0.61 |

As illustrated in Table 3, any reduction in the integral seal results in a significant loss in the dewatering capability of the air press. Specifically, approximately 25% less water was removed (0.61 pounds/pound versus 0.81) when the integral seal was lost, even though the plenum and collection box were still in apparent contact with the fabrics. The associated 2% loss in post dewatering consistency would translate to approximately a 10% reduction in machine speed on a machine that was speed limited due to drying limitations. Such a limitation would be expected on a wet-pressed machine that was converted to the configuration of this invention.

The previous experiment was an attempt to illustrate the best possible result that might be obtained using known technologies, such as that described in U.S. Pat. No. 5,230,776 to Valmet Corporation. In actual practice, it is unlikely the equipment could even be operated as described above due to the excessive noise generated during the experiment and the jet of air issuing form the non-integrally sealed dewatering equipment. Though not specified, in actual practice, it is thought that the equipment described in U.S. Pat. No. 5,230,776 would be operated with a gap of 1 inch or more, a condition under which significantly more dewatering would be lost and much greater air consumption would result. In practical terms, such inefficiency leads to so much additional energy consumption and reduced speed as to render such technology unsuitable for commercial equipment.

Example 9

A wet web was formed, with a fiber blend of 50:50 bleached kraft northern softwood and bleached kraft eucalyptus, into a 20 gsm sheet at 2000 fpm as described in Example 1. The wet web was then vacuum dewatered using 4 vacuum boxes at vacuum levels of approximately 18, 18, 17 and 21 inches respectively. A vacuum box consistency sample was taken. The results are shown in Table 4.

Example 10

The experiment of Example 9 was repeated but with a steam "blow box" (Devronizer) added to increase the dewatering. The steam box was not integrally sealed to the vacuum box, and it thus thought to be similar to an apparatus disclosed in U.S. Pat No. 5,230,776. Steam flow to the Devronizer was approximately (300 pounds) per hour. Again a consistency sample was taken to determine the increase attributable to the addition of the steam blow box. The results are shown in Table 4.

Example 11

The experiment of Example 8 was repeated but with the integrally sealed air press of Example 1 added to the process. The air press was operated at 15 psig plenum pressure and a vacuum level of 17 inches of mercury. Again, a consistency sample was taken to determine the increase attributable to the addition of the integrally sealed air press. The results are shown in Table 4.

TABLE 4

| ID | Consistency % |
|---|---|
| Example 9 | 24.2 |
| Example 10 | 24.8 |
| Example 11 | 33.3 |

The data of Table 4 clearly shows the significant gain in consistency associated with using the integrally-sealed air press relative to the use of the steam blow box. The blow box increased the consistency by 0.6% while the integrally sealed air press increased the consistency by an additional 8.5% beyond that achieved by the steam blow box. Since the wet web was already dewatered over four vacuum boxes to reach the 24.2% consistency (Example 9), it is not practical to add enough vacuum and/or steam blow boxes to raise the consistency to a level where commercially viable speeds can be achieved. However, with the addition of the integrally-sealed air press (Example 11), the consistency can be raised to a level where commercial speeds are obtainable with a modified wet-pressed design.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation, headbox, forming fabrics, web transfers, creping and drying. Therefore, the invention should not be limited by the specific embodiments described, but only by the claims and all equivalents thereto.

We claim:

1. A method for making a cellulosic web, comprising:

(a) depositing an aqueous suspension of papermaking fibers between an endless first fabric and an endless second fabric to form a wet web wherein the wet web is sandwiched between the first and second fabrics;

(b) dewatering the wet web to a consistency of about 30 percent or greater using a noncompressive dewatering device that is adapted to cause a pressurized fluid at about 5 pounds per square inch gauge or greater to flow substantially through the web due to an integral seal formed with the wet web;

(c) pressing the dewatered wet web against the surface of a heated drying cylinder to at least partially dry the dewatered wet web; and, (d) drying the dewatered wet web to a final dryness.

2. A method for making a cellulosic web, comprising:

(a) depositing an aqueous suspension of papermaking fibers between an endless first fabric and an endless second fabric to form a wet web wherein the wet web is sandwiched between the first and second fabrics;

(b) dewatering the wet web to a consistency of about 10 to about 30 percent;

(c) supplementally dewatering the wet web to a consistency of about 30 to about 40 percent using an air press that is adapted to cause a pressurized fluid at about 5 pounds per square inch gauge or greater to flow substantially through the wet web due to an integral seal formed between an air plenum and a collection device to give the dewatered wet web a bulk of about 8 cubic centimeter per gram or greater;

(d) pressing the dewatered wet web against the surface of a heated drying cylinder with a fabric to preserve the bulk of about 8 cubic centimeter per gram or greater; and, (e) drying the dewatered wet web to a final dryness.

3. A method for making a cellulosic web, comprising:

(a) depositing an aqueous suspension of papermaking fibers between an endless first fabric and an endless second fabric to form a wet web wherein the wet web is sandwiched between the first and second fabrics;

(b) passing the wet web sandwiched between the first and second fabrics between an air plenum and a collection device with the second fabric disposed between the wet web and the collection device, the air plenum and collection device being operatively associated and adapted to create a pressure differential across the wet web of about 30 inches of mercury or greater and a stream of pressurized fluid through the wet web of about 10 standard cubic feet per minute per square inch or greater;

(c) dewatering the wet web using the stream of pressurized fluid to a consistency of about 30 percent or greater;

(d) pressing the dewatered wet web against the surface of a heated drying cylinder with the second fabric; and (e) drying the dewatered wet web to a final dryness.

4. The method of claim 1, wherein the noncompressive dewatering device increases the consistency of the wet web by from about 5 to about 20 percent.

5. The method of claim 2, wherein the wet web is supplementally dewatered to a consistency of about 32 percent or greater.

6. The method of claim 5, wherein the wet web is supplementally dewatered to a consistency of about 34 percent or greater.

7. The method of claim 1 or 2, wherein the pressure differential across the wet web is about 30 inches of mercury or greater.

8. The method of claim 7, wherein the pressure differential across the wet web is from about 35 to about 60 inches of mercury.

9. The method of claim 1, 2, or 3, wherein the pressurized fluid is pressurized to less than about 30 pounds per square inch gauge.

10. The method of claim 2, wherein the collection device comprises a vacuum box that draws a vacuum of greater than 0 to about 25 inches of mercury.

11. The method of claim 2, wherein the dwell time in the air press is about 10 milliseconds or less.

12. The method of claim 11, wherein the dwell time in the air press is about 7.5 milliseconds or less.

13. The method of claim 2, wherein the wet web is traveling at a speed of about 1000 feet per minute or greater and the consistency of the wet web from entering to exiting the air press increases by about 5 percentage points or more.

14. The method of claim 2, wherein the wet web is traveling at a speed of about 2000 feet per minute or greater and the consistency of the wet web from entering to exiting the air press increases by about 5 percentage points or more.

15. The method of claim 1 or 2, wherein the wet web is traveling at a speed of about 2000 feet per minute or greater.

16. The method of claim 2 or 3, wherein about 85 percent or greater of the pressurized fluid fed to the air plenum flows through the wet web.

17. The method of claim 16, wherein about 90 percent or greater of the pressurized fluid fed to the air plenum flows through the wet web.

18. The method of claim 1, 2, or 3, wherein the temperature of the pressurized fluid is about 300 degrees Celsius or less.

19. The method of claim 18, wherein the temperature of the pressurized fluid is about 150 degrees Celsius or less.

20. The method of claim 2 or 3, wherein the heated drying cylinder includes a dryer hood and the second fabric that is pressed against the drying cylinder separates from the dryer hood prior to the dewatered wet web entering the dryer hood.

21. The method of claim 2 or 3, wherein the second fabric that is pressed against the drying cylinder wraps the drying cylinder for less than the full distance that the dewatered wet web is in contact with the drying cylinder.

22. The method of claim 1, 2, or 3, wherein the dewatered wet web is transferred to the heated drying cylinder using a pair of transfer rolls that form an extended wrap for a predetermined span.

23. The method of claim 22, wherein one or both of the transfer rolls are not loaded against the heated drying cylinder.

24. The method of claim 22, wherein one or both of the transfer rolls are loaded against the heated drying cylinder.

25. The method of claim 1 or 2, wherein the dewatered wet web is pressed against the drying cylinder with a pressing pressure of about 350 pounds per lineal inch or less.

26. The method of claim 2 or 3, wherein a release agent is added to the second fabric that is pressed against the heated drying cylinder to facilitate the transfer of the dewatered wet web.

27. The method of claim 1 or 2, wherein the flow of pressurized fluid transfers the dewatered wet web to the second fabric.

28. The method of claim 2 or 3, wherein the dewatered wet web is removed from the heated drying cylinder without creping.

29. The method of claim 1, 2, or 3, wherein the dewatered wet web is dried to about 95 percent consistency or more and thereafter creped.

30. The method of claim 1, 2, or 3, wherein the dewatered wet web is partially dried to a consistency of from about 40 to about 80 percent on the surface of the heated drying cylinder, wet creped, and thereafter final dried to a consistency of about 95 percent or greater.

31. An absorbent tissue sheet made by the method of claims 1, 2, or 3.

32. The method of claim 1 or 2, further comprising transferring the wet web to the second fabric and sandwiching the wet web between the second fabric and a support fabric before using the noncompressive dewatering device.

33. The method of claim 1, 2, or 3, wherein the wet web is formed on a modified crescent-former tissue machine.

34. The method of claim 1, 2, or 3, wherein the second fabric replaces a felt fabric on a crescent-former tissue machine.

35. The method of claim 2 or 3, wherein the air plenum is located within the circuit of the endless second fabric.

36. The method of claim 2, wherein the air plenum is located within the circuit of the support fabric.

37. The method of claim 3, wherein the air plenum is located within the circuit of the endless first fabric.

38. The method of claim 1, 2, or 3, wherein a vacuum shoe transfers the dewatered wet web to the second fabric prior to transfer of the dewatered wet web to the heated drying cylinder.

39. The method of claim 1, 2, or 3, wherein the first fabric is a forming fabric.

40. The method of claim 1, 2, or 3, wherein the second fabric is a molding fabric.

41. The method of claim 1, wherein the noncompressive dewatering device is comprised of an air plenum and a collection device.

42. The method of claim 2, 3, or 41, further comprising positioning cross-machine direction sealing members to deflect the course of travel of the wet web and the first and second fabrics toward the collection device.

43. The method of claim 42, wherein the minimum amount of impingement of the cross-machine direction sealing members into the support fabrics is defined by the $$\text{equation: } h(\min) = \frac{T}{W}\left(\cosh\left(\frac{Wd}{T}\right) - 1\right);$$

$$\text{equation: } h(\min) = \frac{T}{W}\left(\cosh\left(\frac{Wd}{T}\right) - 1\right);$$

where: "T" is the tension of the first and second fabrics measured in pounds per inch; "W" is a pressure differential across the web measured in pounds per square inch; and "d" is a gap between a sealing blade and the collection device in the machine direction measured in inches.

44. The method of claim 1, 2, or 3, further comprising configuring the second fabric to provide an unsupported sheet wrap angle of the dewatered wet web about a pressure roll of less than 90 degrees.

45. The method of claim 44, wherein the unsupported sheet wrap angle of the dewatered wet web about a pressure roll is less than 45 degrees.

46. The method of claim 44, wherein the unsupported sheet wrap angle of the dewatered wet web about a pressure roll is less than 10 degrees.

47. The method of claim 1, wherein the noncompressive dewatering device comprises a vacuum box that draws a vacuum of greater than 0 to about 25 inches of mercury.

48. The method of claim 1, wherein a pressurized portion of the noncompressive dewatering device is located within the circuit of the endless second fabric.

49. The method of claim 1, wherein a pressurized portion of the noncompressive dewatering device is located within the circuit of the support fabric.

50. The method of claim 3, wherein the dwell time in the air plenum and the collection device is about 10 milliseconds or less.

51. The method of claim 50, wherein the dwell time in the air plenum and the collection device is about 7.5 milliseconds or less.

52. The method of claim 3, wherein the wet web is traveling at a speed of about 1000 feet per minute or greater and the consistency of the wet web from entering to exiting the air plenum and collection device increases by about 5 percentage points or more.

53. The method of claim 3, wherein the wet web is traveling at a speed of about 2000 feet per minute or greater and the consistency of the wet web from entering to exiting the air plenum and collection device increases by about 5 percentage points or more.

* * * * *